US007887341B2

(12) United States Patent
Liao

(10) Patent No.: US 7,887,341 B2
(45) **Date of Patent: *Feb. 15, 2011**

(54) SOCKET ASSEMBLY

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/385,770

(22) Filed: Apr. 20, 2009

(65) Prior Publication Data

US 2010/0075540 A1 Mar. 25, 2010

(30) Foreign Application Priority Data

Sep. 19, 2008 (TW) ..... 97136046 A

(51) Int. Cl.
*H01R 13/44* (2006.01)

(52) U.S. Cl. ..... 439/131; 439/501

(58) Field of Classification Search ..... 439/131, 439/501, 650, 651, 652; 191/12.2 R, 12.4; 174/53, 66, 67

See application file for complete search history.

(56) References Cited

U.S. PATENT DOCUMENTS 5,071,367 A * 12/1991 Luu ..... 439/501
6,179,665 B1 * 1/2001 Rossman et al. ..... 439/654
6,433,274 B1 * 8/2002 Doss et al. ..... 174/50
6,722,917 B2 * 4/2004 Huang ..... 439/501
7,025,627 B2 * 4/2006 Rosenthal et al. ..... 439/501
7,223,122 B2 * 5/2007 Mori ..... 439/574
7,442,090 B2 * 10/2008 Mori et al. ..... 439/652
7,467,971 B2 * 12/2008 Lin et al. ..... 439/501
7,528,323 B2 * 5/2009 Wu et al. ..... 174/66
7,654,855 B2 * 2/2010 Liao ..... 439/441

* cited by examiner

*Primary Examiner*—Thanh-Tam T Le
(74) *Attorney, Agent, or Firm*—Rosenberg, Klein & Lee

(57) ABSTRACT

A socket assembly includes a socket body, a connecting wire, and an electrical connector. The socket body has at least one socket unit and a connector receiving groove. One end of the connecting wire extends to the inside of the socket body and the other end of the connecting wire connects the electrical connector. The connecting wire can be routed around the fringe of the socket body, and the electrical connector can be stored in the connector receiving groove. Thereby, the connecting wire and the electrical connector can be stored inside the socket body when they are not used. Thus, the connecting wire and the electrical connector are convenient to use.

10 Claims, 23 Drawing Sheets

SOCKET ASSEMBLY

BACKGROUND OF THE INVENTION

1. Field of the Invention

The present invention relates to a socket assembly. In particular, the present invention relates to a socket assembly that can rapidly provide a connecting wire and an electrical connector so that the user can easily connect an electronic device.

2. Description of Related Art

Most of the current in-door utility power set-up and planning generally embed the utility hardware within the in-door walls, and the utility power and network signal line may connect to various electronic devices via the conduction from sockets installed on the walls. When the power of an electronic device (such as cell phones, digital still cameras, PDAs, or other portable electronic devices) is exhausted and needs to be connected with the utility power to be operated or charged, or when the electronic device needs to be connected with the network signal line to transmit data, a user can plug the electronic device via a connecting wire and a connector into the socket; thereby the electronic device is connected with the electric power or the network signal wire, so as to obtain the utility power or the network signal.

As the electronic devices advances technologically, the associated electrical connector also advances correspondingly and a variety of electrical connectors are thus designed, such as USB connectors. When the electronic device (i.e. external storage device, which usually already has a female electrical connector built-in) needs to be connected with an electronic equipment (i.e. a computer, which usually already has a female electrical connector built-in), an electrical connector (i.e. a male connector to compliment the female connector) and a connecting wire (i.e. the cable part following the electrical connector which bridges the electronic device and the electronic equipment) are used for electrically connecting the electronic device and the electronic equipment so that the electronic device and the electronic equipment can transmit the electrical power or the signals via the connecting wire.

However, although the socket structure of the prior art can be located with an electrical connector, the socket structure still does not have a connecting wire. When the user needs to connect the electronic device with the socket structure, the user needs to find a proper connecting wire along with the proper electrical connector to match the socket structure. After the user finish using the socket structure, the user needs to remove the connecting wire along with the proper electrical connector, and stores the connecting wire along with the proper electrical connector in a proper location, which can be time-consuming. Moreover, the removed connecting wire along with the proper electrical connector is sometimes lost, which is inconvenient for the user. On the other hand, if the user does not remove the connecting wire along with the proper electrical connector then the exposed connecting wire is messy and can be unaesthetic to the user.

SUMMARY OF THE INVENTION

One particular aspect of the present invention is to provide a socket assembly that can rapidly provide the connecting wire and the electrical connector so that the user can easily connect an electronic device. When the user does not use the connecting wire and the electrical connector, the connecting wire and the electrical connector can be stored in the socket body. Messy connecting wire exposure is thus eliminated and the connecting wire and the electrical connector thereby do not disturb the user.

The socket assembly includes a socket body having at least one socket unit and a connector receiving groove, the socket unit has at least a set of plug holes; a connecting wire, one end of the connecting wire extends into the socket body; and an electrical connector connected with a second end of the connecting wire, wherein the connecting wire selectively routes around the fringe of the socket body, and the electrical connector is selectively received in the connector receiving groove.

The present invention has the following characteristics. The connecting wire and the electrical connector of the present invention are movably located on the modified socket assembly so that the connecting wire and the electrical connector can be pulled outside of the socket body or secured in the socket body. When the user needs to use the connecting wire and the electrical connector, the user merely needs to pull out the connecting wire and the electrical connector from the socket body. The user does not need to separately find the connecting wire and the electrical connector. It is convenient for the user. The user does not need to carry around a connecting wire or an electrical connector, furthermore the user does not need to remove the connecting wire and the electrical connector once the user is done using the socket; since the connecting wire and the electrical connector can be received and secured in the socket body. Furthermore the connecting wire and the electrical connector will not be lost. The messy problem is solved and the connecting wire and the electrical connector do not disturb the user by being exposed or lost.

For further understanding of the present invention, reference is made to the following detailed description illustrating the embodiments and examples of the present invention. The description is for illustrative purpose only and is not intended to limit the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
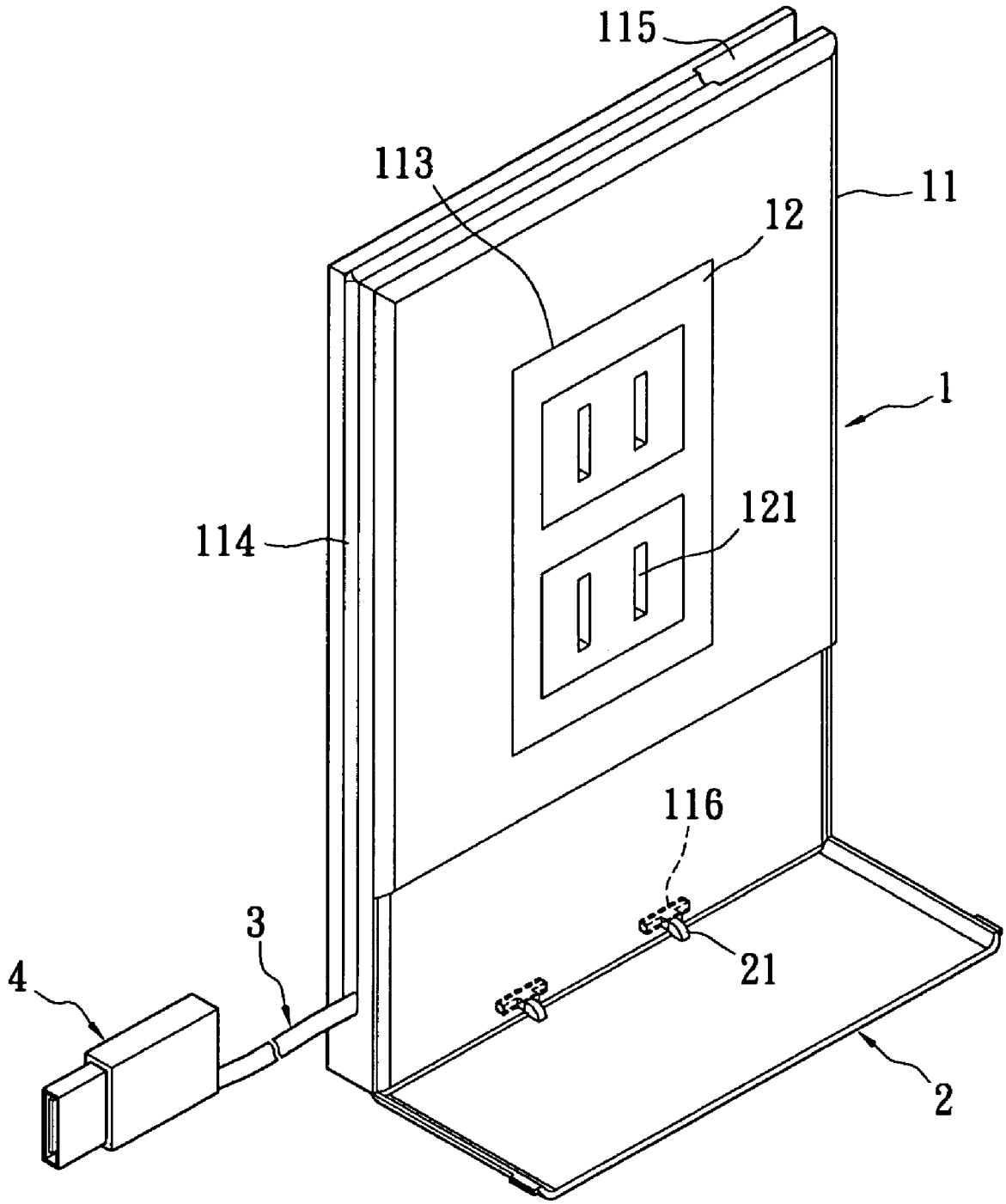
FIG. 1 is a perspective view of the first embodiment of the present invention.
Figure 2:
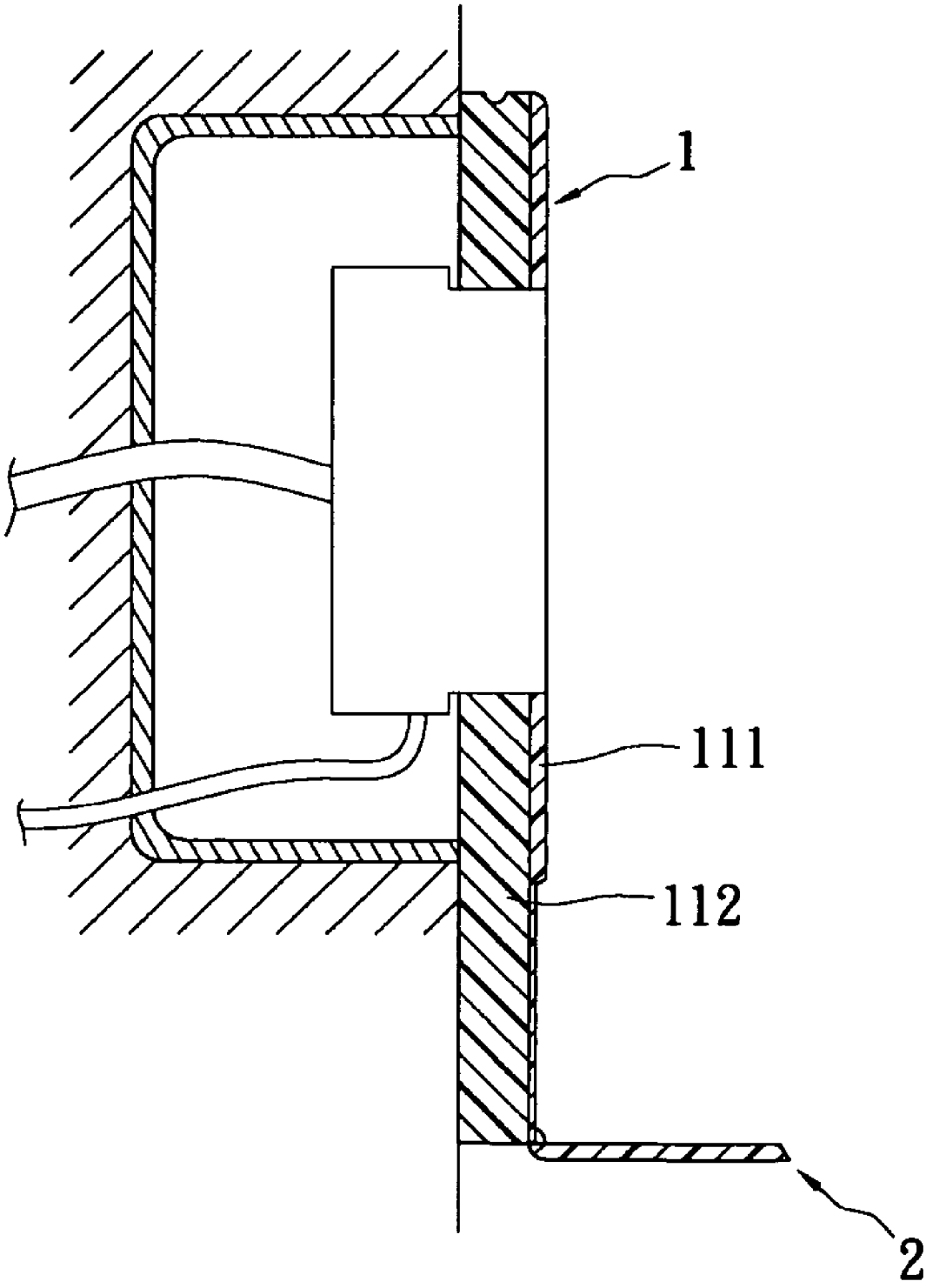
FIG. 2 is a cross-sectional view of the first embodiment of the present invention.
Figure 3:
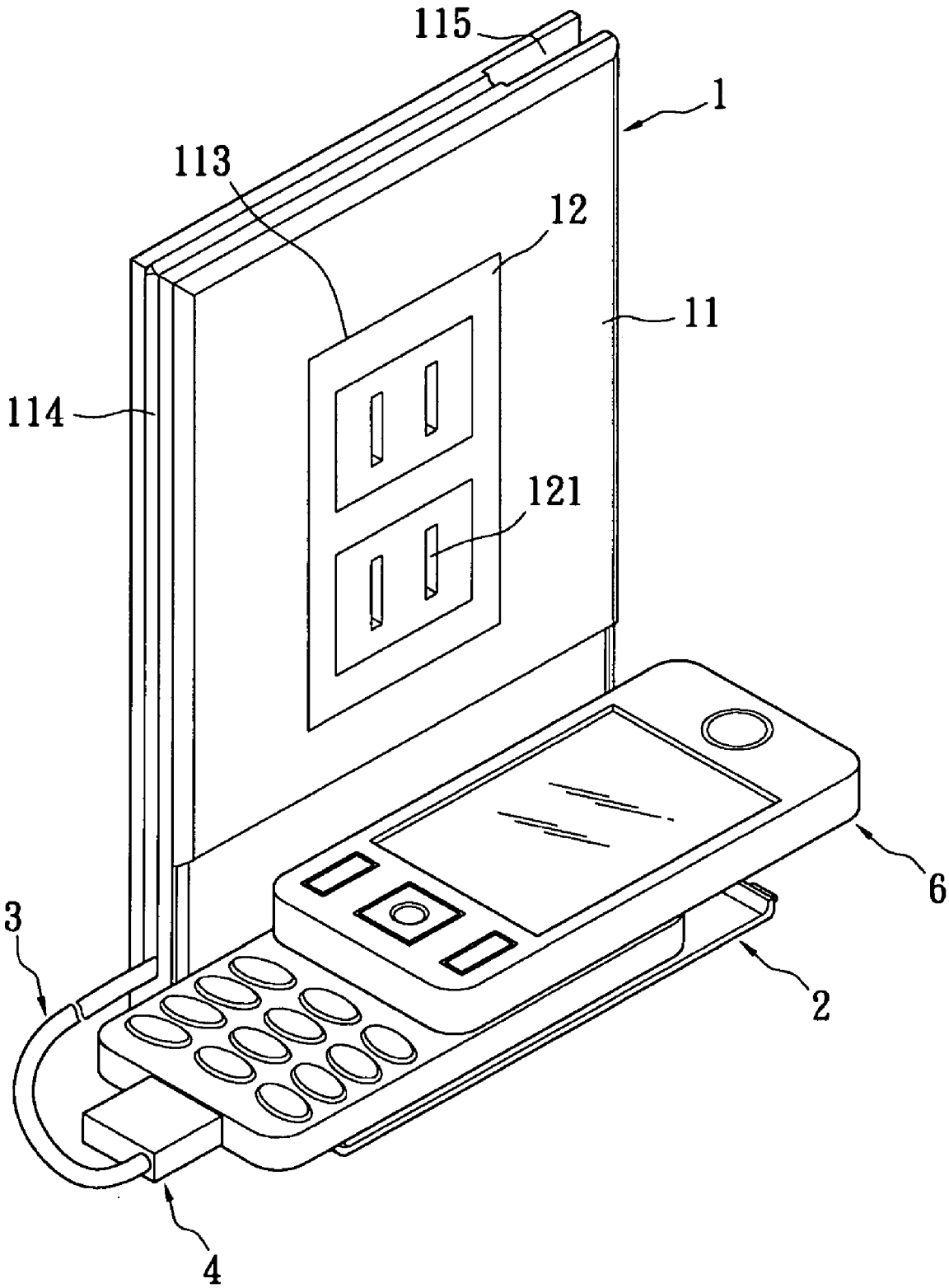
FIG. 3 is a perspective view of the operation status of first embodiment of the present invention.

The present invention provides a socket assembly; reference is made to FIGS. 1-3, which show the socket assembly of the first embodiment of the present invention. The socket assembly includes a socket body 1, a carrying board 2, a connecting wire 3, and an electrical connector 4. In the present embodiment, the socket body 1 has a panel 11 and at least a socket unit 12, The panel 11 is compose of a front board 111 and a rear board 112 that are stacked together. The panel 11 has a wedging portion 113, the wedging portion 113 is a through hole that corresponds to the socket unit 12, wherein the wedging portion 113 correspondingly wedges and connects with the fringe (i.e. outer edge) of the socket unit 12.

A wire slot 114 is indented and located on the fringe of the socket body 1; the wire slot 114 may be used to contain the connecting wire 3, so that the connecting wire 3 may selectively routes around the fringe of the socket body 1 via the wire slot 114. In the present embodiment the wire slot 114 is located on two adjacent fringe sides of the socket body 1. In other words the wire slot 114 is located on the left fringe side and the top fringe side of the socket body 1, but the position of the wire slot 114 is not necessarily limited to the aforementioned left and top side; instead the wire slot 114 may be on any two adjacent fringe sides of the socket body 1, such as the left, right, top, or bottom sides.

A connector receiving groove 115 is located on the fringe of the socket body 1, the connector receiving groove 115 is adjacently connected to one end of the wire slot 114, and the electrical connector 4 is selectively received in the connector receiving groove 115. The bottom side of the panel 11 of the socket body 1 has two first pivoting portions 116, the first pivoting portions 116 is a pivoting hole for pivoting with the carrying board 2

The format and type of the socket unit 12 is not limited, the socket unit 12 wedges with the wedging portion 113 of the panel 11. Therein, the socket unit 12 has at least one set of plug holes 121. The set of plug holes 121 can be plug holes (i.e. female electrical connector or female signal connector) for the electric power, the network, or the telephone. The set of plug holes 121 can be can be a variety of plug holes or electrical connectors.

The carrying board 2 is located at the front side of the panel 11 of the socket body 1. One side of the carrying board 2 has two second pivoting portions 21. The second pivoting portion 21 is a pivoting shaft. One side of the carrying board 2 is pivoted with the two first pivoting portions 116 at the bottom side of the panel 11 via the two second pivoting portions 21 so that the carrying board 2 is rotatably connected with the socket body 1. The carrying board 2 can be rotated downwards to a perpendicular position against the socket body 1 for carrying the electronic device 6. The carrying board 2 also can be rotated upwards to a parallel position against the front side of the panel 11. In other words, the panel 11 is pivoted with the carrying board 2, and the carrying board 2 can be rotated to a perpendicular position against the panel 11 or stacked in a parallel position against the front side of the panel 11.

The connecting wire 3 is generally composed of a conducting body and an insulating layer wrapped around the conducting body. However, the structure and the type of the connecting wire 3 are not limited to specified ones. The connecting wire 3 can be a cable or a bus line, One end (i.e. first end) of the connecting wire 3 extends into the interior part of the panel 11 of the socket body 1, and the other end (i.e. second end) is connected to the electrical connector 4 to electrically connect with the electronic devices (such as a computer). The connecting wire 3 can be selectively routed around the fringe of the socket body 1; in other words, the connecting wire 3 may be routed and received the fringe of the socket body 1 via the wire slot 114; so that when the connecting wire 3 is not used, the connecting wire 3 can be fastened in the wire slot 114. Additionally, the connecting wire 3 can be pulled out from the wire slot 114 for connecting with electronic devices.

The electrical connector 3 can be a universal serial bus (USB) connector, an IEEE1394 connector, a high-definition multimedia interface (HDMI) connector, an. audio video (AV) connector, or a direct current (DC) connector. The electrical connector 4 can be male-type connector or female-type connector. The electrical connector 4 is connected with the second end of the connecting wire 3. In the electrical connector 4, there is a plurality of pins (not shown). The pins are made of conducting materials. The pins are electrically connected with the conducting body in the connecting wire 3 so that the electrical connector 4 is electrically connected with the connecting wire 3. Therein, when the connecting wire 3 is routed and received around the fringe of the socket body 1 via the wire slot 114, the electrical connector 4 is also correspondingly received within the aforementioned connector receiving groove 115.

As shown in FIGS. 1-3, when the user wants to electrically connect an electronic equipment 6 (such as a cell phone) with the electrical connector 4, the user rotates the carrying board 2 to make the carrying board 2 be in a horizontal position (i.e. perpendicular against the socket body 1). Next, the electrical connector 4 is plugged into the electronic equipment 6, and the electronic equipment 6 is stably placed on the carrying board 2 while the electronic equipment 6 is being charged or receiving data signal via the connecting wire 3 and the electrical connector 4. Also, in another embodiment the aforementioned carrying board 2 may be omitted; then the electronic equipment 6 needs to be placed at another appropriate location.

The socket assembly of the present invention combines the connecting wire 3 and the electrical connector 4, which are movably located on the socket body 1. Thereby when a user require the usage of the connecting wire 3 and the electrical connector 4, the two may be pulled outside of the wire slot 114 and the connector receiving groove 115 of the socket body 1. The user does not need to find the connecting wire 3 and the electrical connector 4 that would otherwise be stored separately. The proximity and compact storage feature of the present invention is convenient for the user. The user does not need the connecting wire 3 and the electrical connector 4 separately; furthermore the user does not need to remove the connecting wire 3 and the electrical connector 4. The connecting wire 3 and the electrical connector 4 can respectively be received in the wire slot 114 and the connector receiving groove 115 of the socket body 1. The connecting wire 3 and the electrical connector 4 will not be lost. The messy problem of connecting wire exposure is solved and the connecting wire 3 and the electrical connector 4 will not inconvenience the user by getting lost or exposed in a messy manner.

Figure 4:
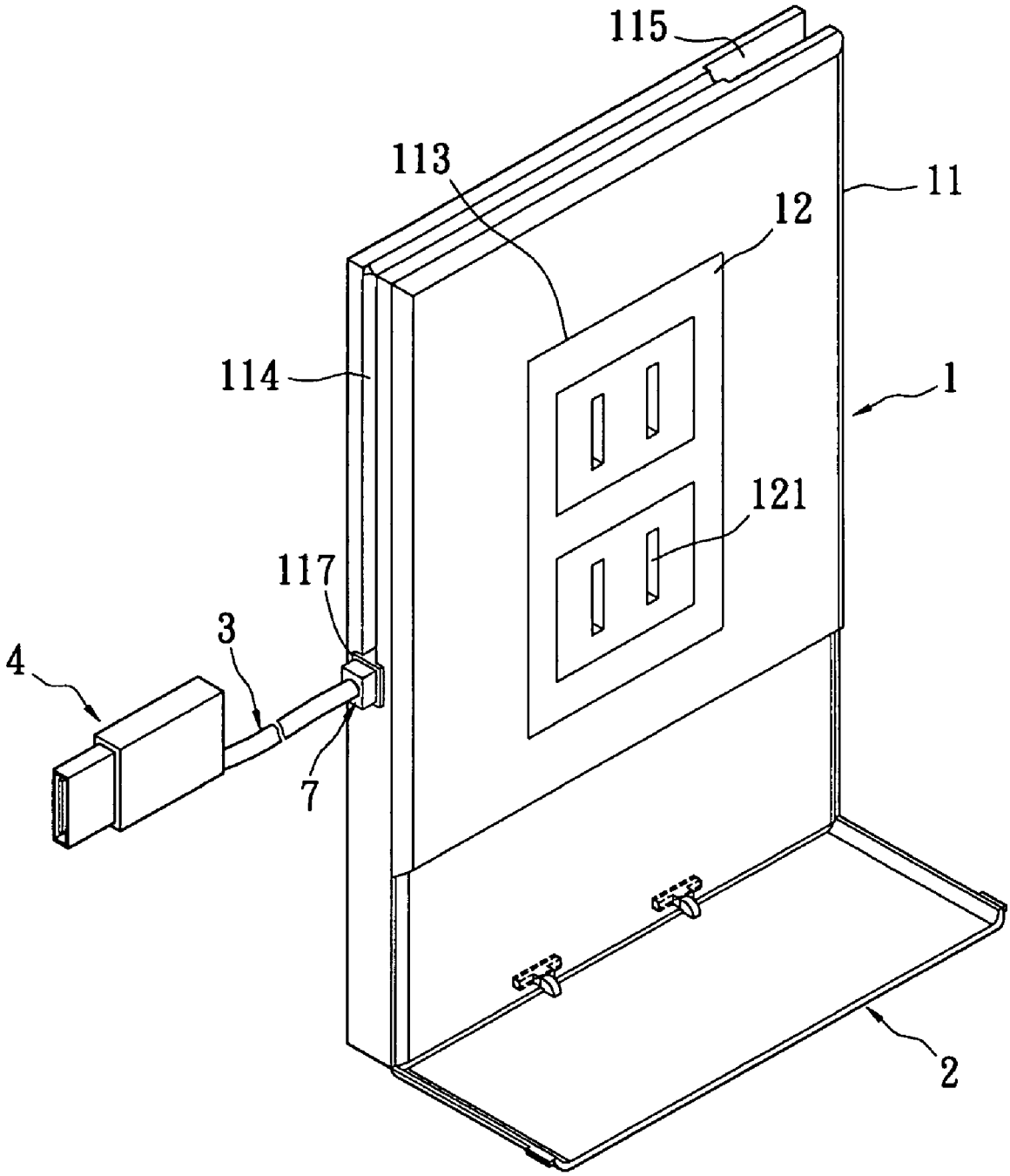
FIG. 4 is a perspective view of the second embodiment of the present invention.

Reference is made to FIG. 4, which shows the second embodiment of the modified socket assembly of the present invention. Therein one end of the connecting wire 3 has a wire connector 7, and the wire connector 7 is plugged into a corresponding wire connector base 117 positioned at the fringe of the socket body 1. The wire connector base 117 is a female-type connector and may electrically connect with an electronic equipment. In the present embodiment, the connecting wire 3 and the electrical connector 4 may separate from the socket body 1.

Figure 5:
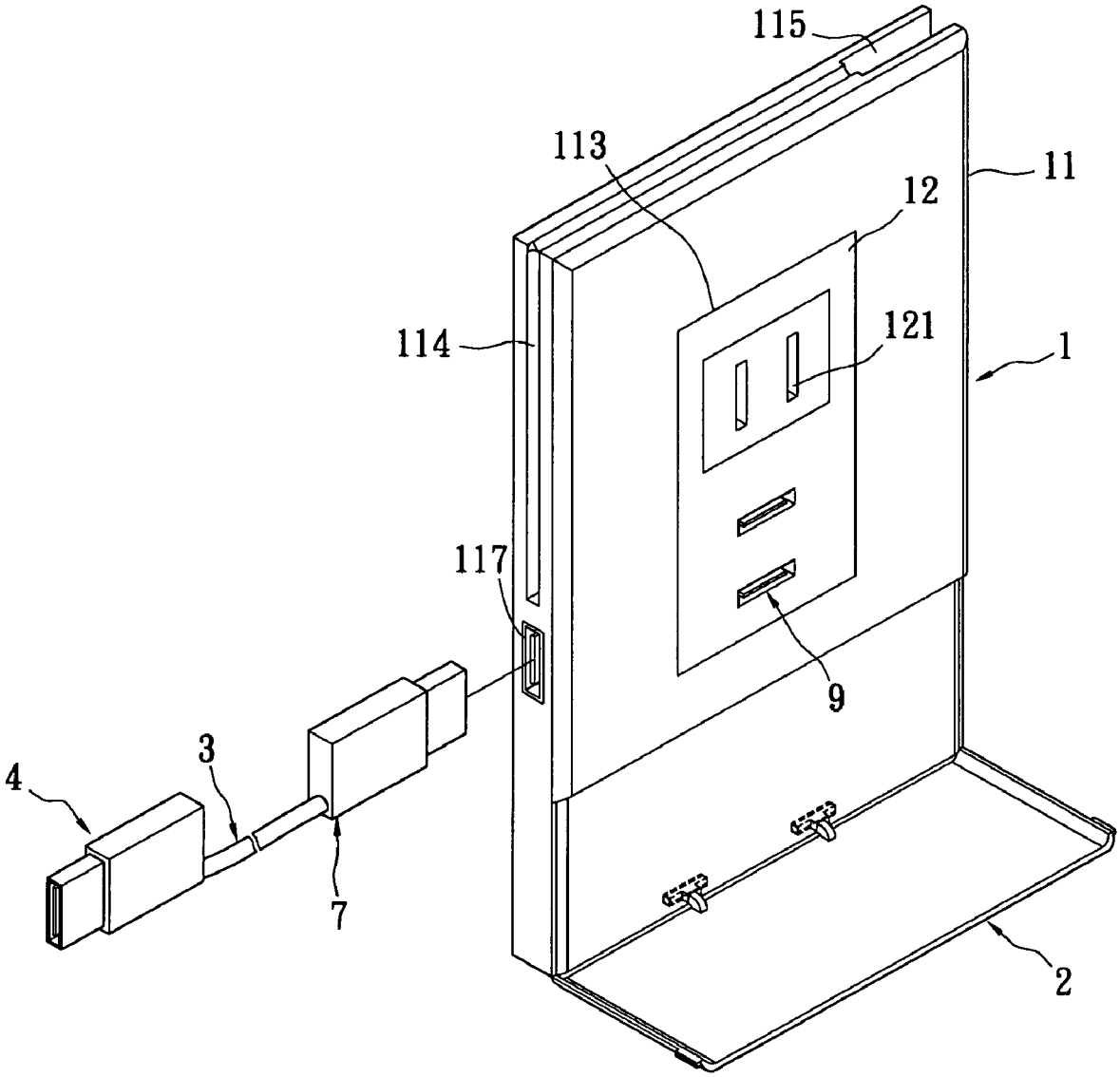
FIG. 5 is a perspective view of the third embodiment of the present invention.

Reference is made to FIG. 5, which shows the third embodiment of the present invention. The socket body 1 has a connector 9, one end of the connecting wire 3 has a wire connector 7, and the wire connector 7 is plugged into a corresponding wire connector base 117 positioned at the fringe of the socket body 1. Therein the connector 9, the wire connector 7, the wire connector base 117, and the electrical connector 4 may be a USB connector, an IEEE1394 connector, a HDMI connector, an AV connector, or a DC connector.

Figure 6:
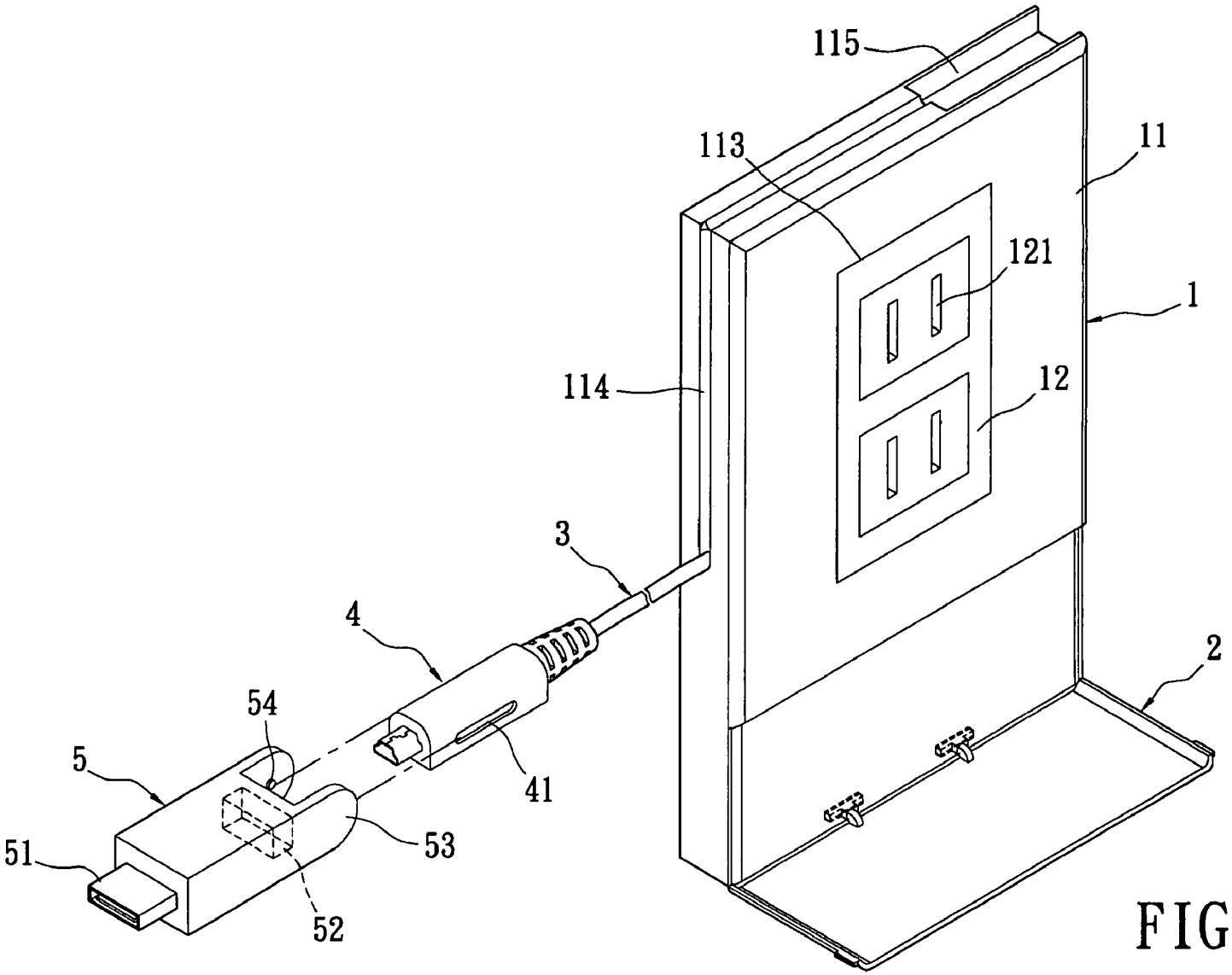
FIG. 6 is a perspective view of the fourth embodiment of the present invention.

Reference is made to FIG. 6, which shows the fourth embodiment of the present invention, the electrical connector 4 is different from the previous embodiments. In the present embodiment the electrical connector 4 is combined with a converting head 5. The front end and the rear end of the converting head 5 respectively have a first plugging element 51 (i.e. male connector) and a second plugging element 52 (i.e. female connector). Each of the two sides of the converting head 5 has a side arm 53. The inner edge surfaces of the two side arms 53 respectively have a pivoting portion 54. The pivoting portion 54 is a convex column. The two side arms 53 can be rotated or fastened. In this embodiment, the two side arms 53 are fastened. This means that the two side arms 53 is fastened and combined with the two sides of the converting head 5. When the two side arms 53 are rotated, the two side arms 53 are respectively pivoted with the two sides of the converting head 5. The first plugging element 51 and the second plugging element 52 are electrically connected together. Pins (not shown in the figure) are located between the first plugging element 51 and the second plugging element 52 so that first plugging element 51 and the second plugging element 52 are electrically connected.

Two sides of the electrical connector 4 respectively indent to form a sliding slot 41. The electrical connector 4 can move forwards and backwards by extending or pushing back the connecting wire 3 through the receiving slot 112, in order for the electrical connector 4 to assemble with the converting head 5. The pivoting portion 54 is received in the sliding slot 41 so that the electrical connector 4 is movably assembled with the converting head 5. At the same time, the front end of the electrical connector 4 is plugged into the second plugging element 52 to be electrically connected. Therefore, the converting head 5 is electrically connected with the connecting wire 3 via the electrical connector 4.

The converting head 5 is assembled with the electrical connector 4 by using a pivoting way (i.e. the sliding slot 41 connected with the pivoting portion 54 to allow for pivoting) and a slidable connecting way (i.e. sliding slot 41 connected with the pivoting portion 54, which allows the converting head 5 to slide in and connect with the electrical connector 4). There can be both a related rotation movement and sliding movement between the electrical connector 4 and the converting head 5; so that the converting head 5 can be plugged with the front end of the electrical connector 4 by using the sliding movement, and when the converting head 5 is not used, the converting head 5 can be rotated to another direction by the rotation movement and then merely the electrical connector 4 is exposed for use. Therefore, the converting head 5 does not need to be disassembled.

Figure 7:
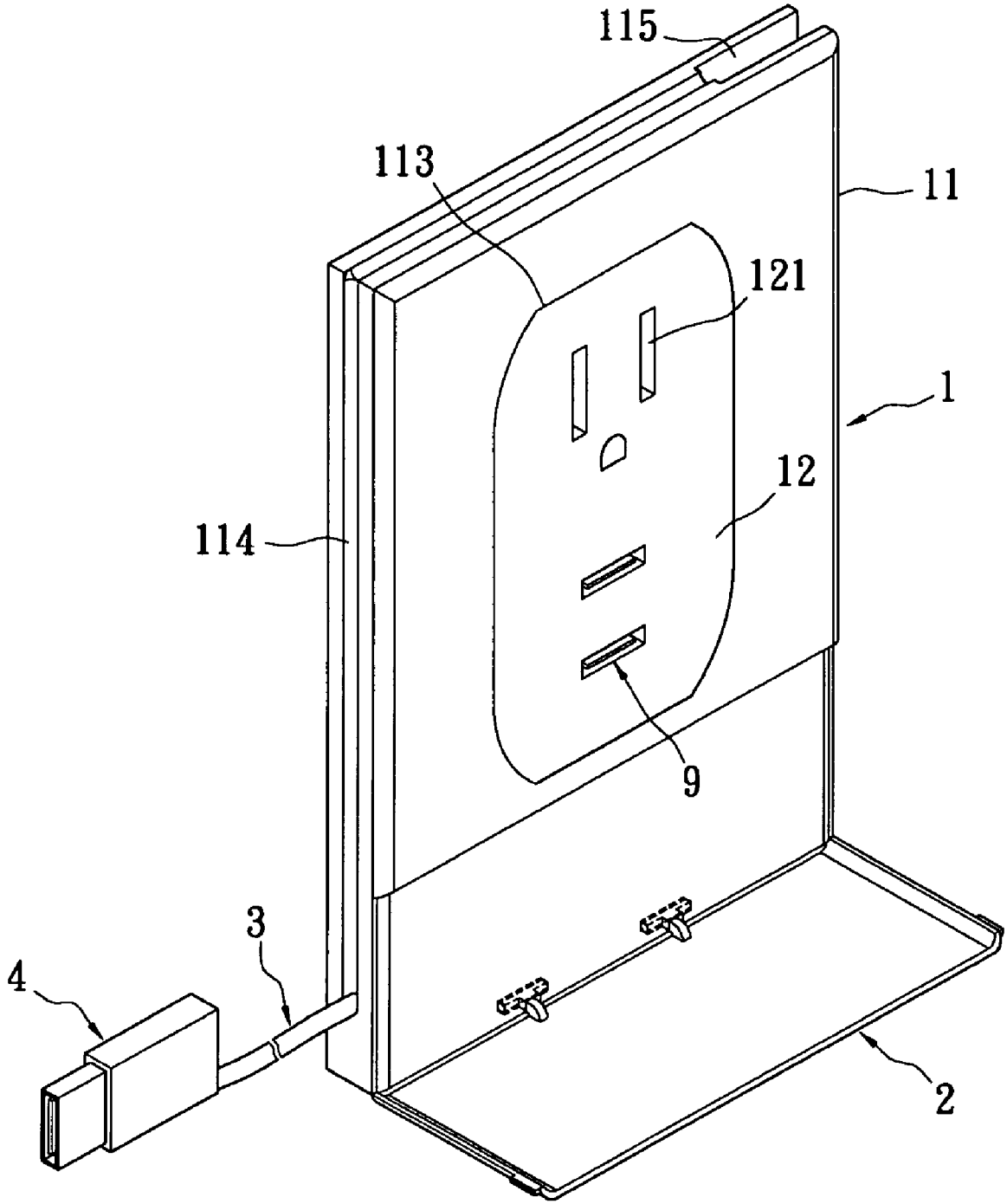
FIG. 7 is a perspective view of the fifth embodiment of the present invention.

Reference is made to FIG. 7, which shows the fifth embodiment of the present invention. Therein the socket unit 12 is of US specification, and the wire slot 114 is located at the fringed of the panel 11 of the socket body 1. Therein the socket body 1 also has a connector 9, and the connector 9 may be a USB connector, an IEEE1394 connector, a HDMI connector, an AV connector, or a DC connector.

Figure 8:
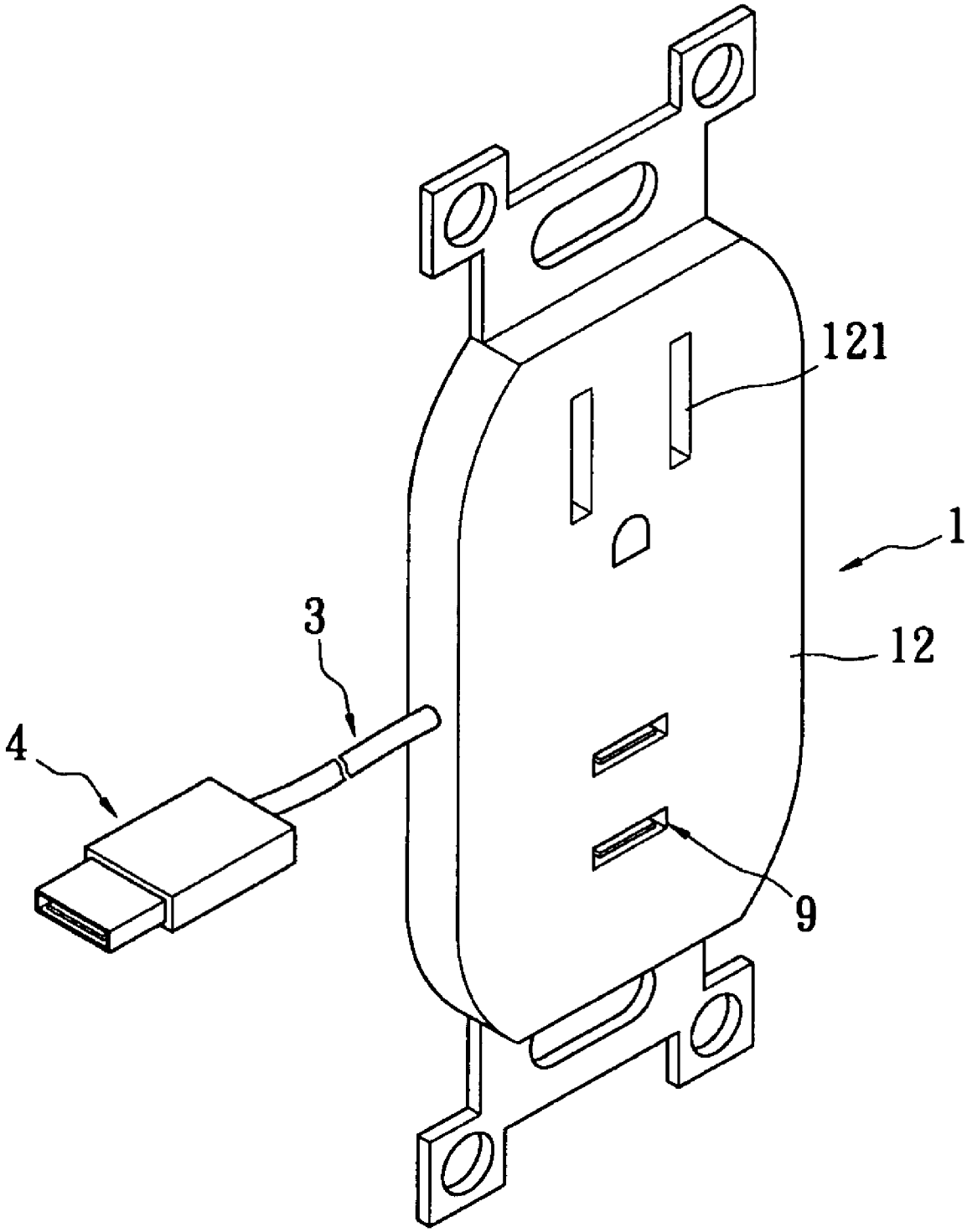
FIG. 8 is a perspective view of the socket unit of the socket assembly of the sixth embodiment of the present invention.

Reference is made to FIG. 8, which shows the sixth embodiment of the present invention. Therein the socket body 1 does not have a panel. The socket unit 12 is of US specification, and one end of the connecting wire 3 extends into the socket unit 12 of the socket body 1.

Figure 9:
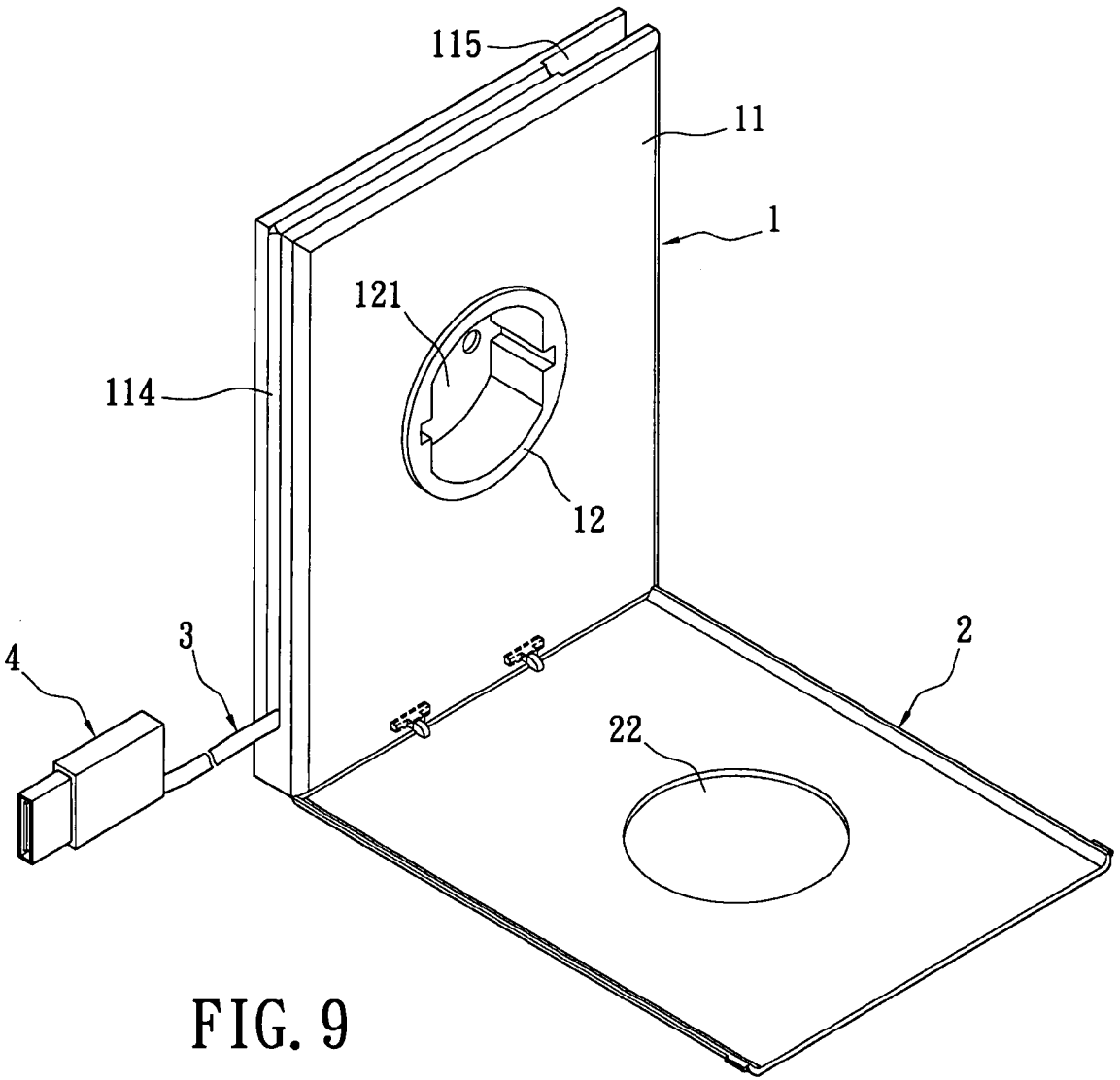
FIG. 9 is a perspective view of the seventh embodiment of the present invention.

Reference is made to FIG. 9, which shows the seventh embodiment of the present invention. Therein the socket unit 12 is of European specification, and the carrying board 2 has an opening hole 22 corresponding to the plug holes 121 of the socket unit 12. When the carrying board 2 wedges with the panel 11, the plug holes 121 of the socket unit 12 is exposed through the opening hole 22, so that the plug holes 121 of the socket unit 12 is convenient to use.

Figure 10:
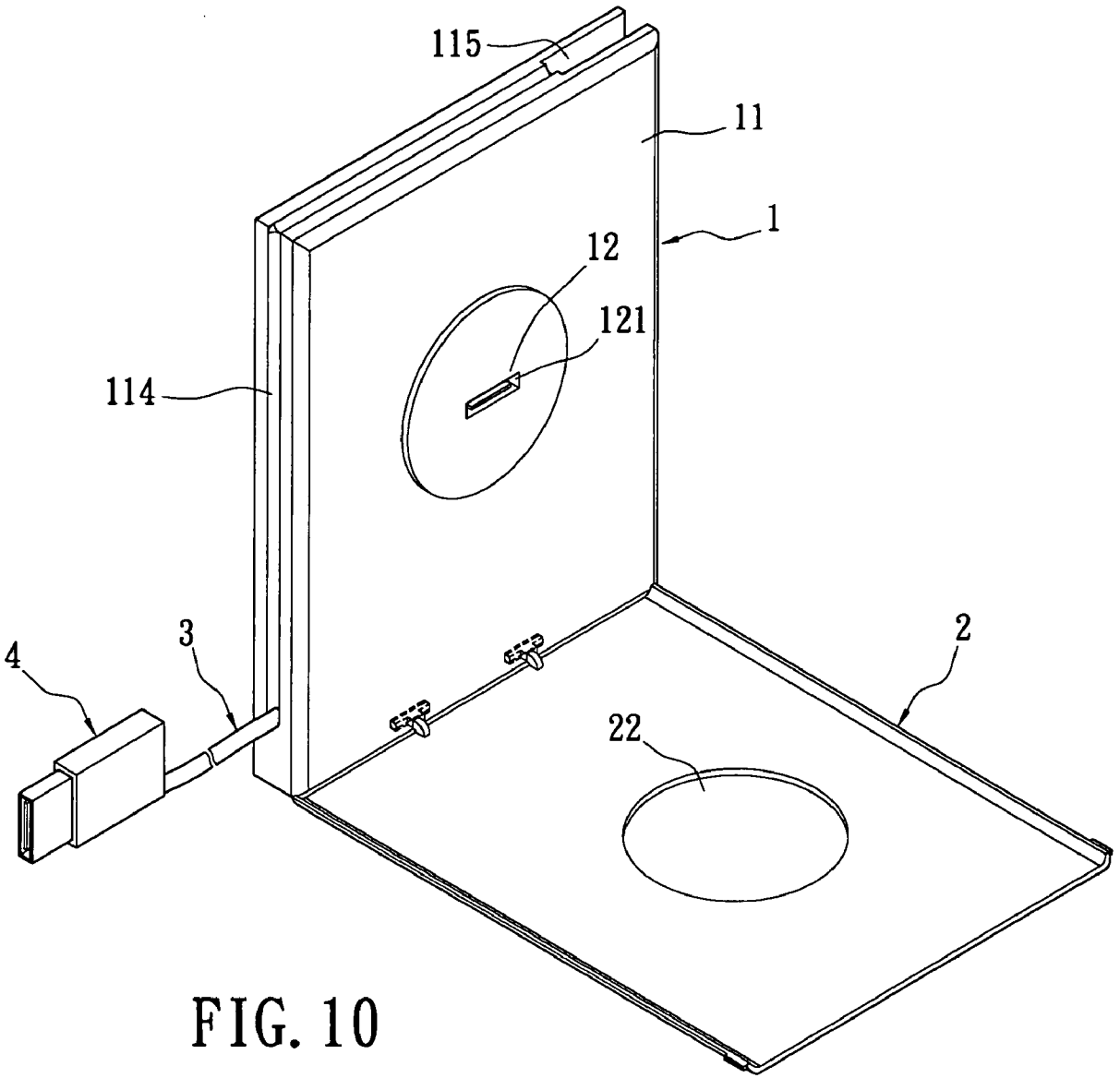
FIG. 10 is a perspective view of the eighth embodiment of the present invention.

Reference is made to FIG. 10, which shows the eight embodiment of the present invention, the socket unit 12 is a USB connector.

Figure 11:
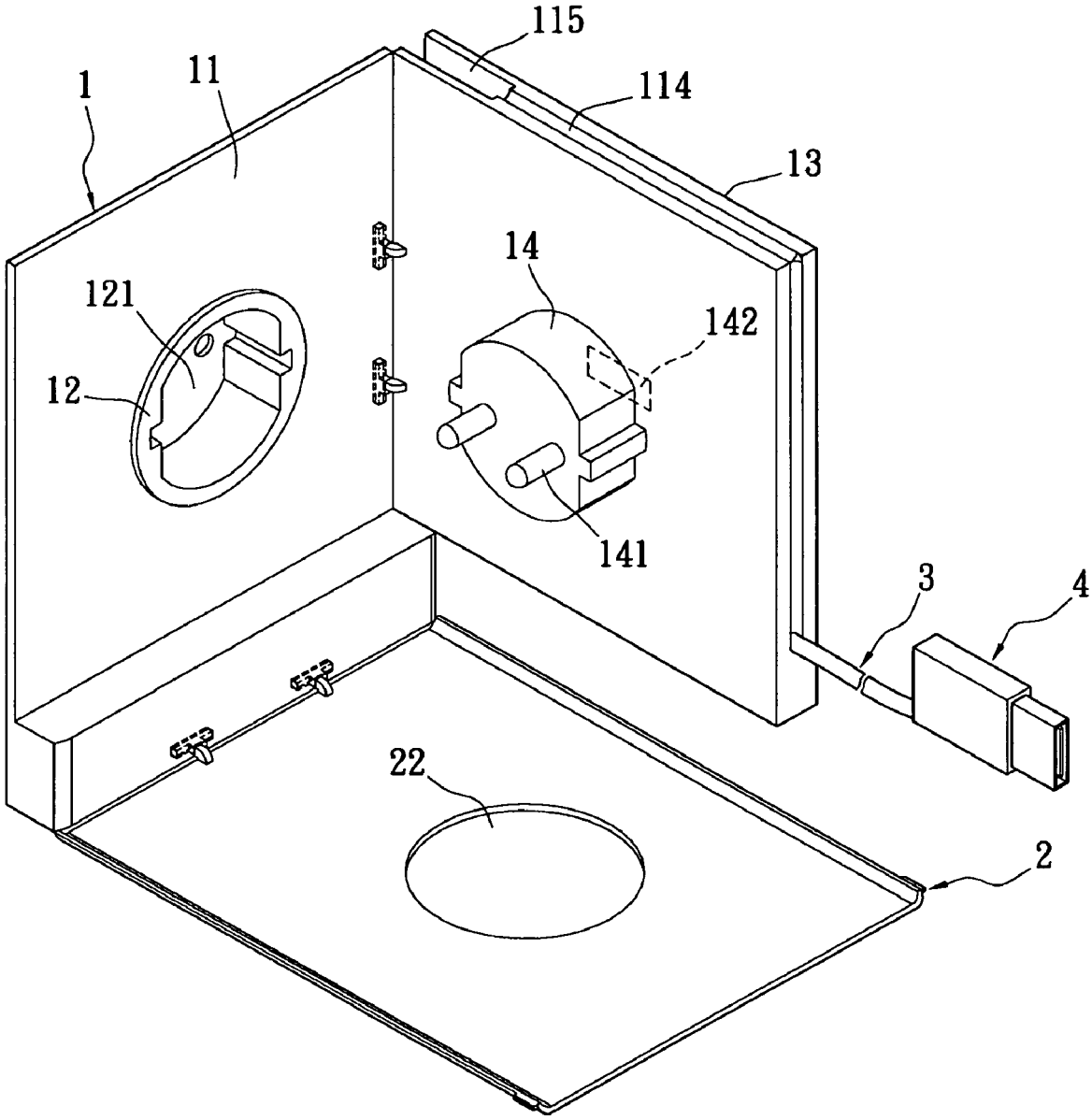
FIG. 11 is a perspective view of the ninth embodiment of the present invention.

Reference is made to FIG. 11, which shows the ninth embodiment of the present invention, the socket unit 12 is of European specification, and the front side of the panel 11 has a front panel 13. The front panel 13 is coupled to one side of the panel 11. One end of the connecting wire 3 extends into the front panel 13. A charging base 14 is located on the front panel 13. The rear side of the charging base 14 has a pin 141, and the front side of the charging base 14 has a connector 142. Therein when the charging base 14 needs to be used, then the charging base 14 may be rotated in relation to the panel 11, so that the charging base 14 may be selectively plugged into the plug holes 121 of the socket unit 12. Thereby the pin 141 of the charging base 14 may achieve electrical contact with the pin (not shown) of the plug holes 121 of the socket unit 12, and power may be transmitted to the connector 142 of the charging base 14 to charge an electronic equipment. When the charging base 14 is not used, the charging base 14 can be separated from the plugging hole 121 of the socket unit 12 so that the charging base 14 does not affect the usage of the plugging hole 1211 of the socket unit 12. The wire slot 114 and the connector receiving groove 115 are located at the fringe of the front panel 13, so that the connecting wire 3 and the electrical connector 4 may respectively be received within the wire slot 114 and the connector receiving groove 115 of the front panel 13.

Figure 12:
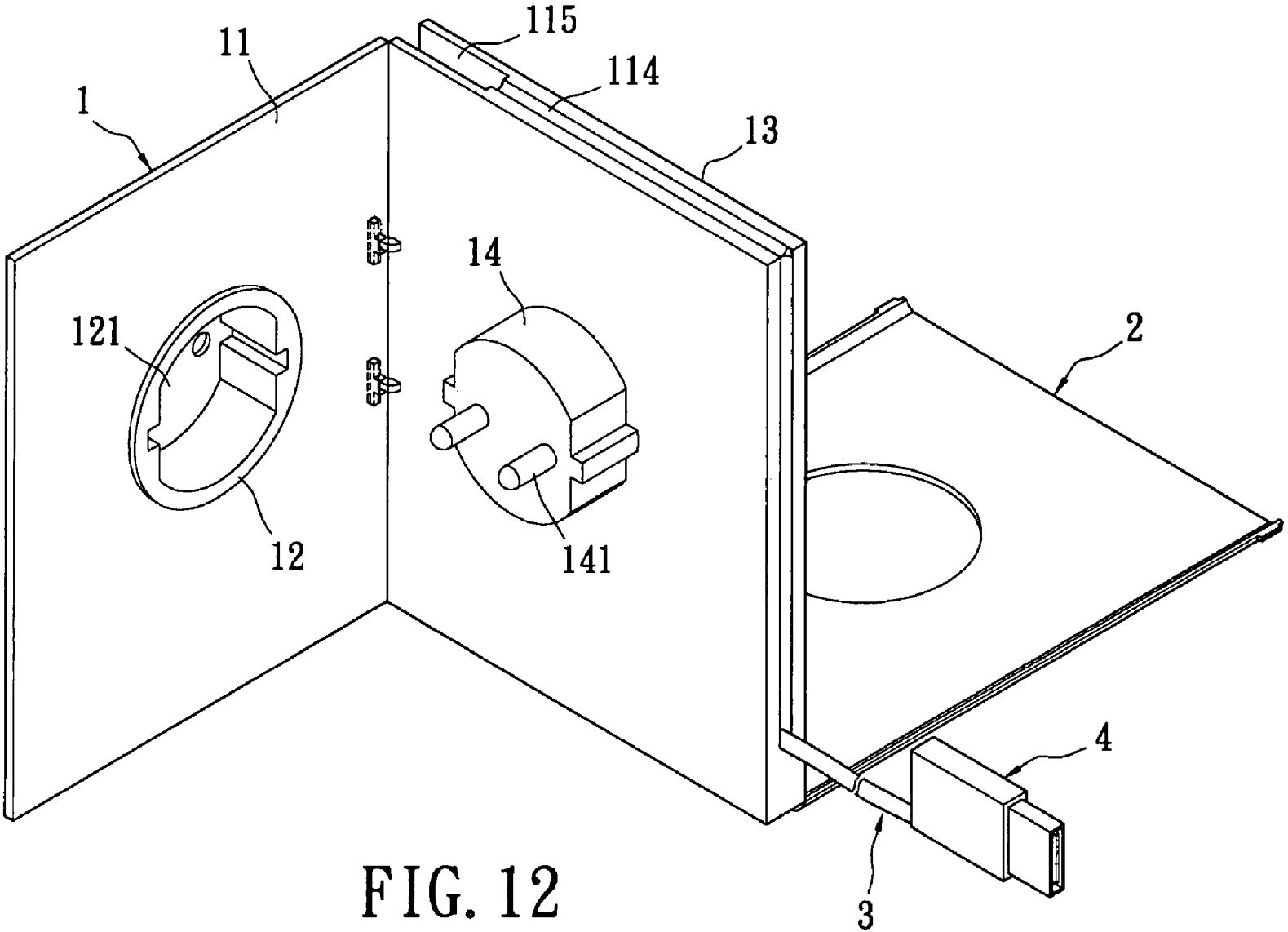
FIG. 12 is a perspective view of the tenth embodiment of the present invention.

Reference is made to FIG. 12, which shows the tenth embodiment of the present invention. Therein the carrying board 2 is coupled to the front panel 13.

Figure 13:
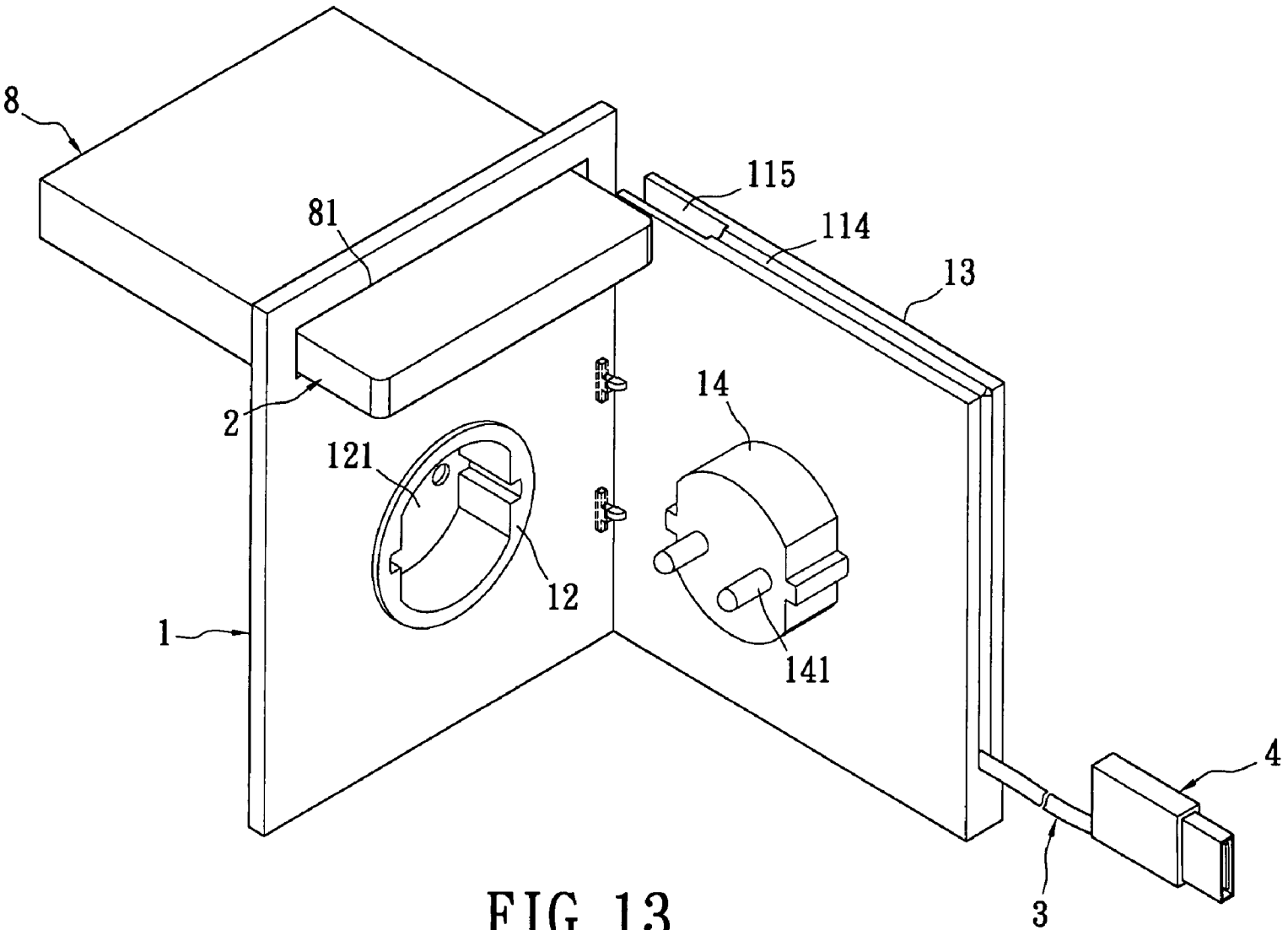
FIG. 13 is a perspective view of the eleventh embodiment of the present invention.
Figure 14:
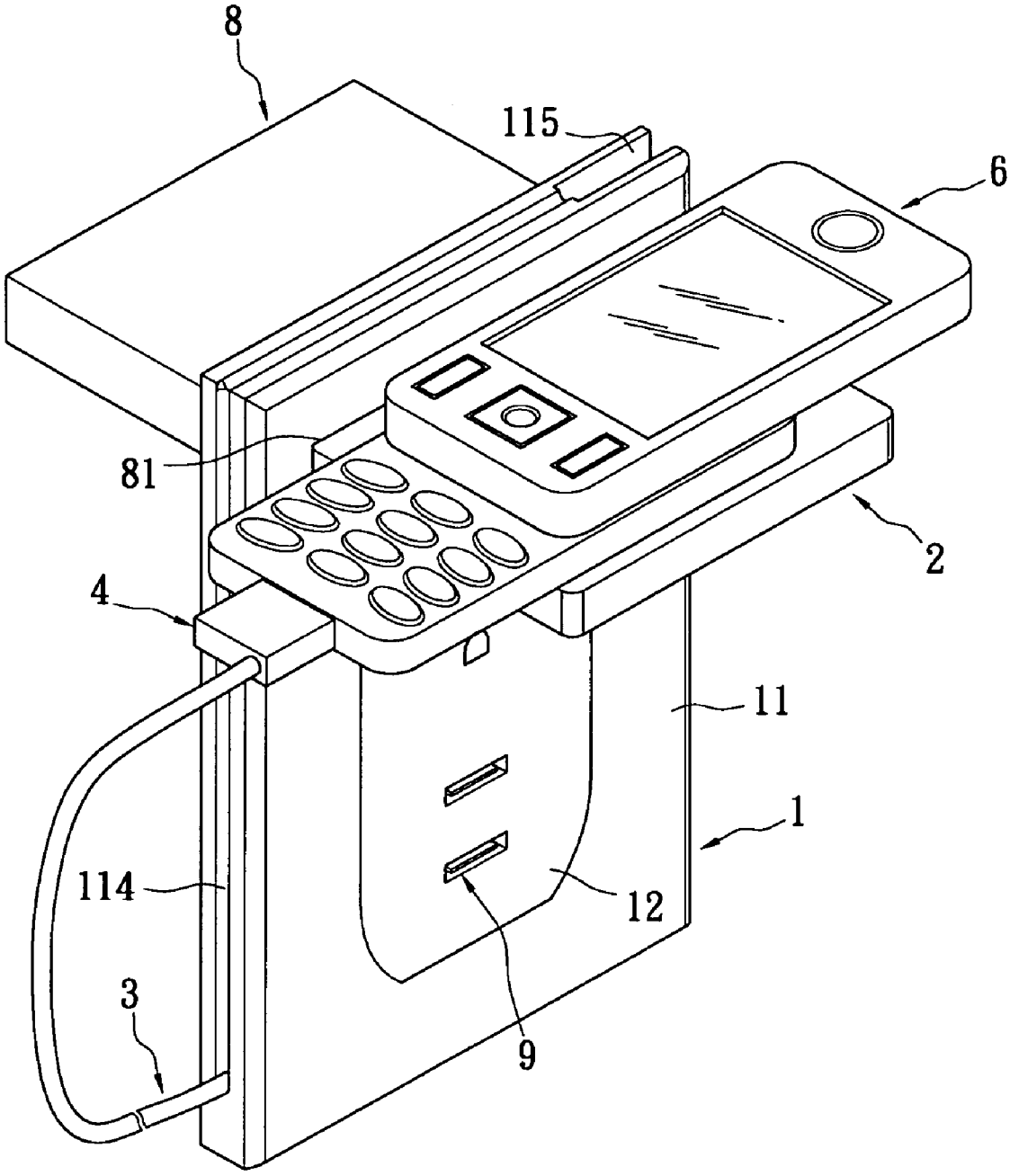
FIG. 14 is a perspective view of operation status of the twelfth embodiment of the present invention.

Reference is made to FIGS. 13 and 14, which shows the eleventh and twelfth embodiment of the present invention. Therein a receiving box 8 is further included. The front side of the receiving box 8 has an opening 81. The receiving box 8 is located at the rear side of the panel 11. The carrying board 2 is located in the opening 81 of the receiving box 8, and the carrying board 2 can slide forwards and backwards along the opening 81. In this embodiment, the user pulls the carrying board 2 to outside of the receiving box 8 along the opening 81, plugs the electrical connector 4 with the electronic equipment 6 (as shown in FIG. 14), and places the electronic equipment 6 on the carrying board 2. Thereby, the electronic equipment 6 is stably placed on the carrying board 2 while the electronic equipment 6, the connecting wire 3, and the electrical connector 4 perform charging or network data-transmission. On the other hand, when the carry board 2 is not needed, it can slide back and be received by the receiving box 8.

Figure 15:
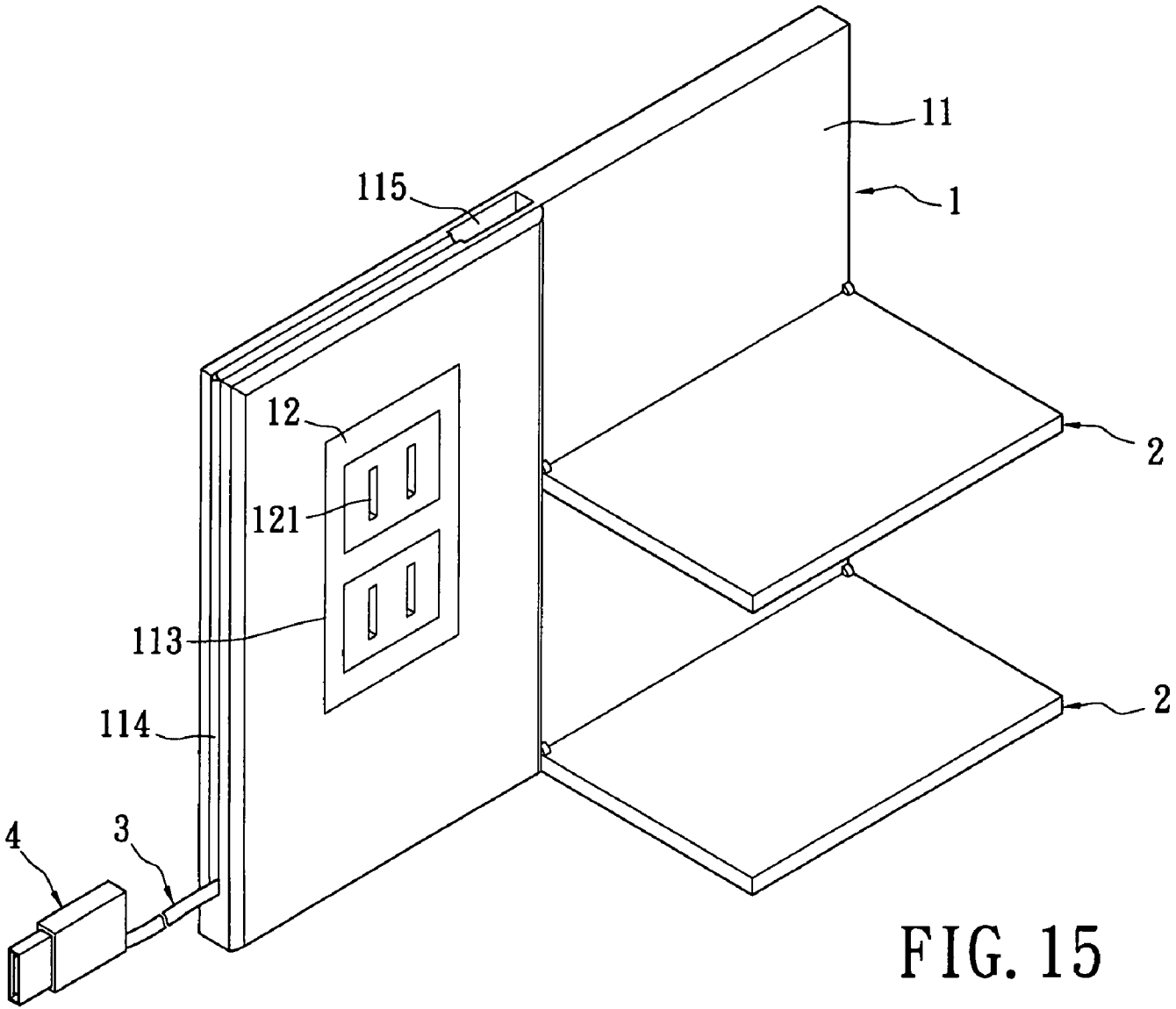
FIG. 15 is a perspective view of the thirteenth embodiment of the present invention.

Reference is made to FIG. 15, which shows the thirteenth embodiment of the present invention, which has two carrying boards 2, and the two carrying boards 2 are respectively located on the upper position and the lower position. Therein the two carrying board 2 may be rotably connected with the socket body 1, and may be used to place two electronic equipments.

Figure 16:
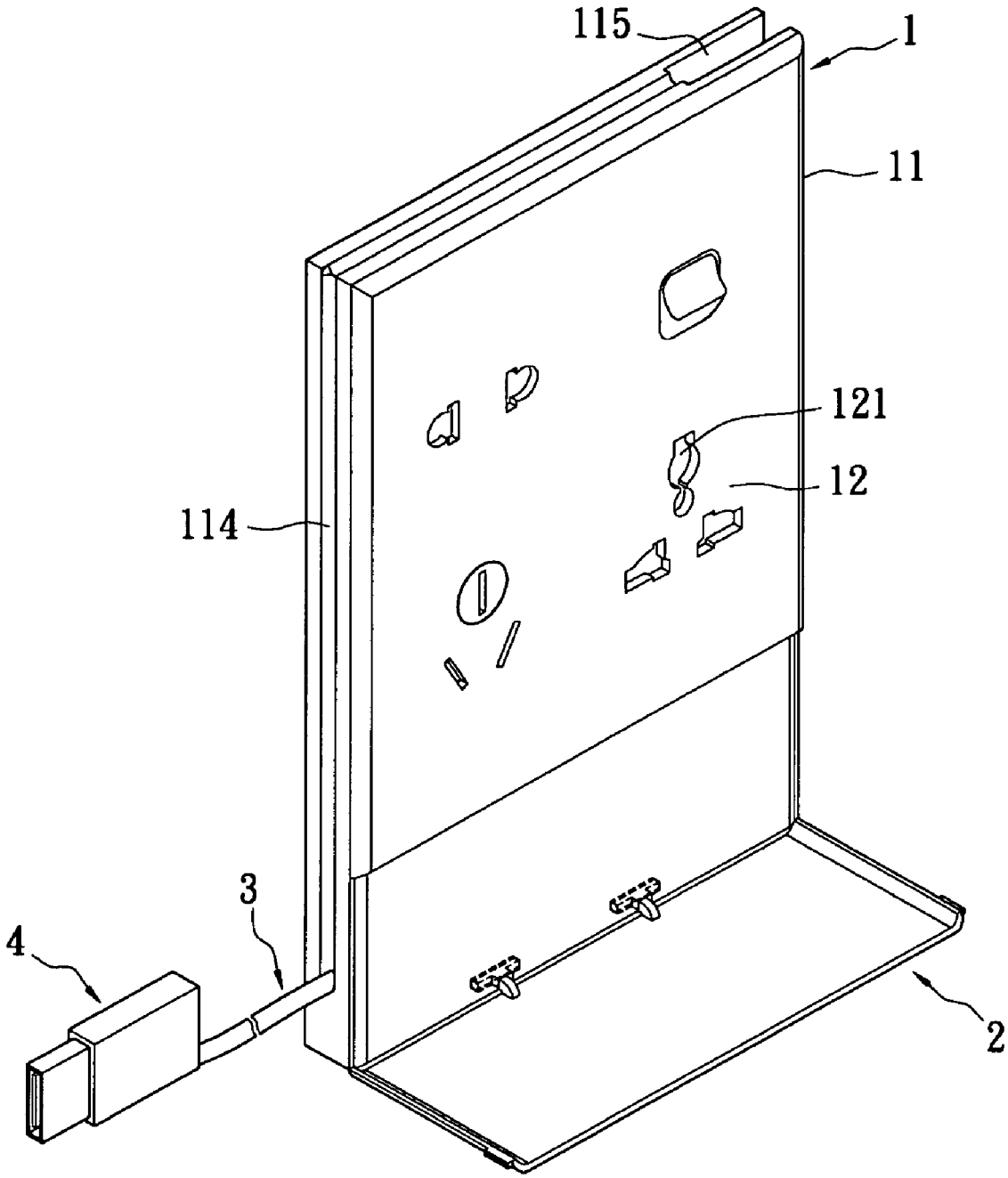
FIG. 16 is a perspective view of the fourteenth embodiment of the present invention.

Reference is made to FIG. 16, which shows the fourteenth embodiment of the present invention. Therein the socket unit 12 is of China specification, and the panel 11 is combined with the socket unit 12 into one seamless structure.

Figure 17:
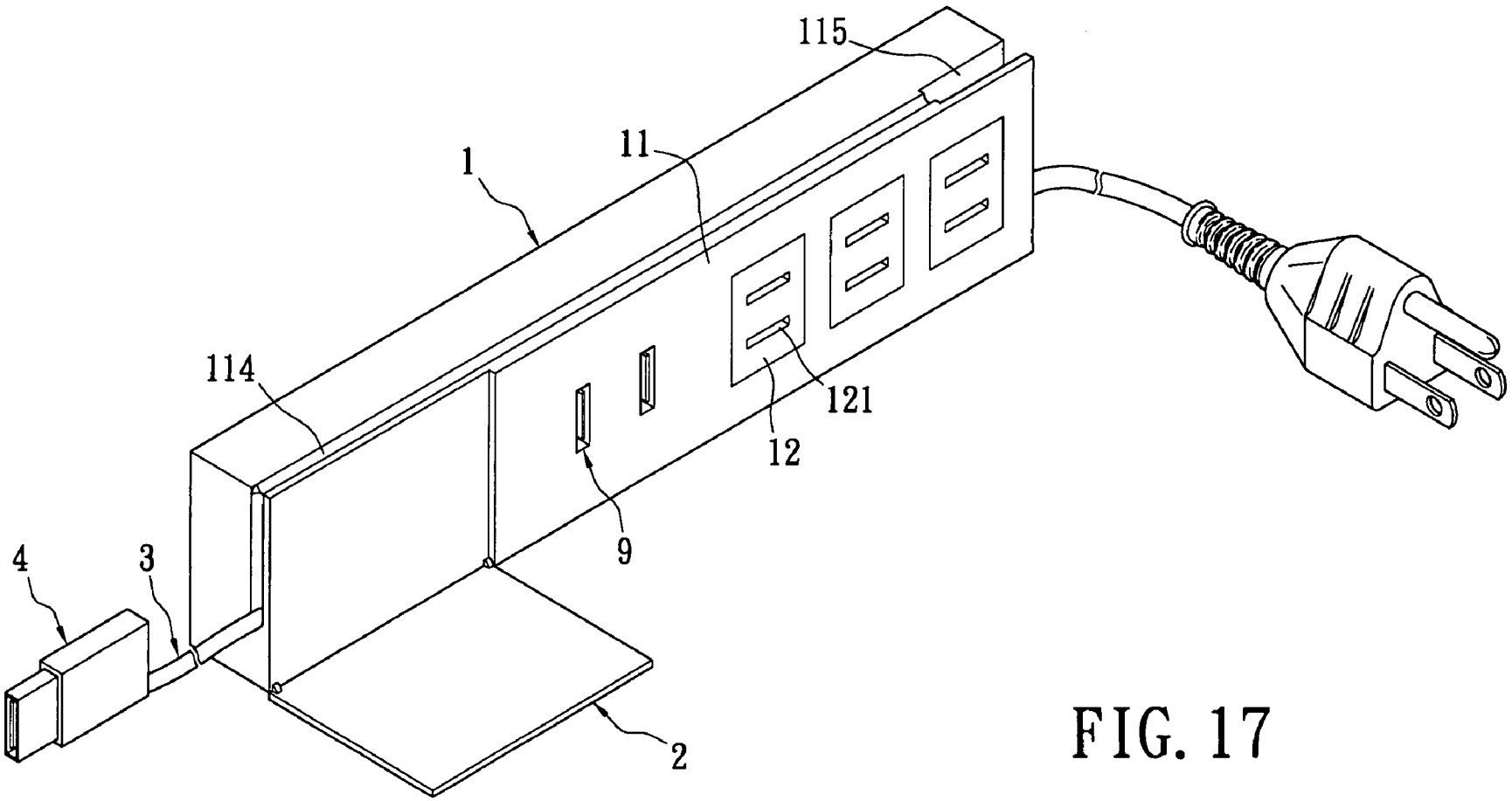
FIG. 17 is a perspective view of the fifteenth embodiment of the present invention.

Reference is made to FIG. 17, which shows the fifteenth embodiment of the present invention. Therein the modified socket assembly structure is a power strip structure; the socket body 1 has a connector 9, and the carrying board 2 is coupled with the panel 11.

Figure 18:
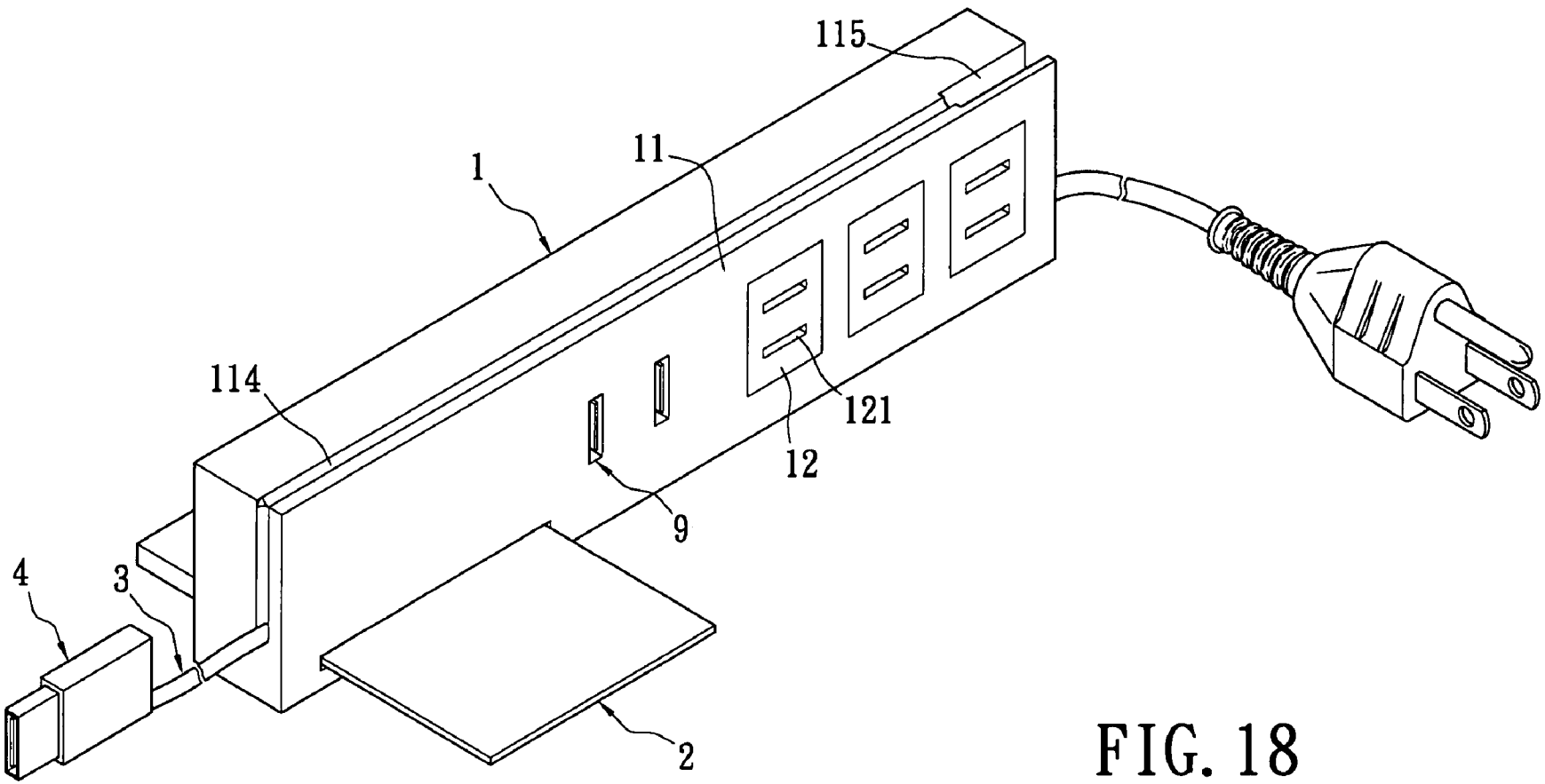
FIG. 18 is a perspective view of the sixteenth embodiment of the present invention.

Reference is made to FIG. 18, which shows the sixteenth embodiment of the present invention. Therein the socket assembly structure is a power strip structure; the socket body 1 has a connector 9, and the carrying board is forwards and backwards slidably connected with the socket body 1.

Figure 19:
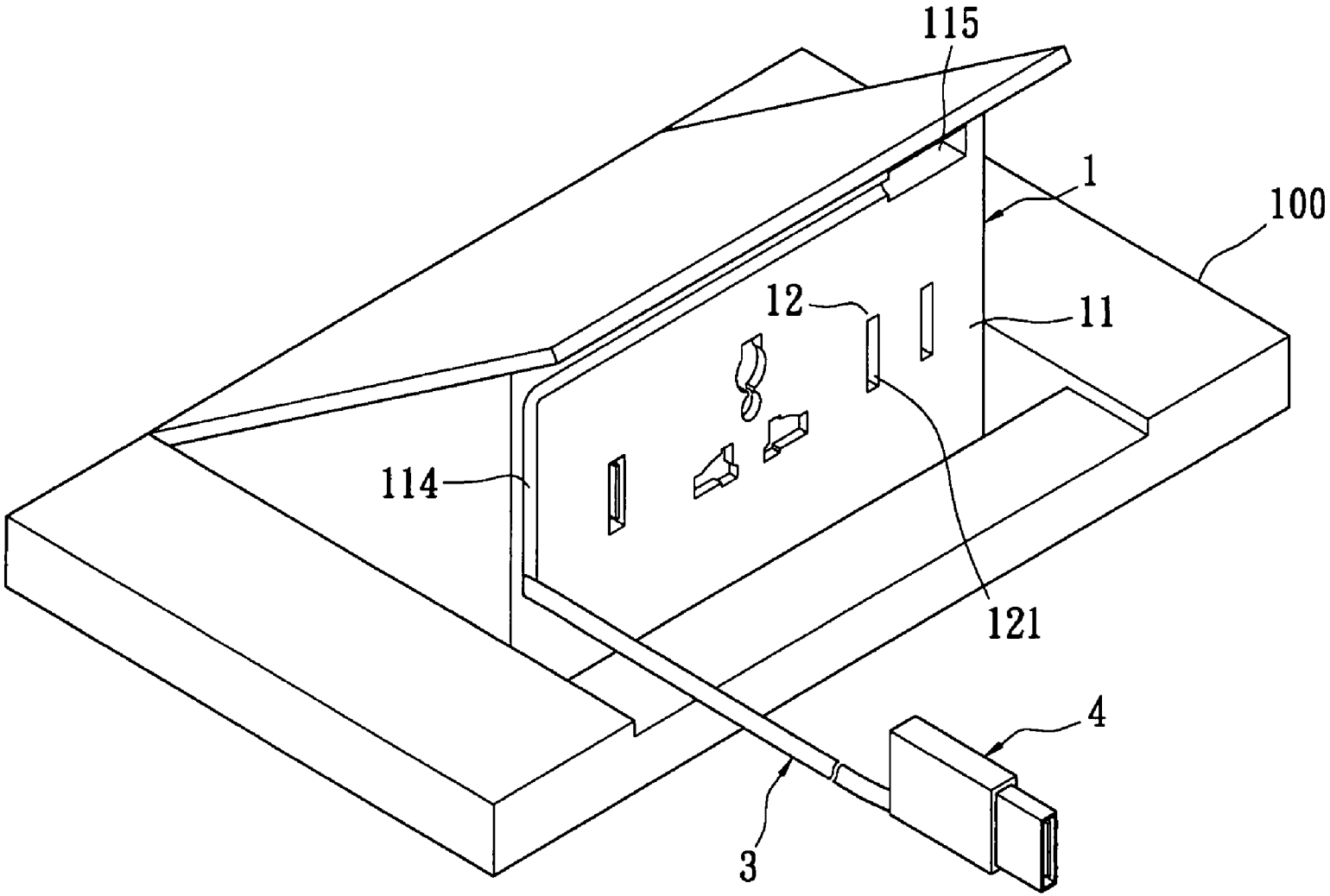
FIG. 19 is a perspective view of the seventeenth embodiment of the present invention.

Reference is made to FIG. 19, which shows the seventeenth embodiment of the present invention. Therein the socket assembly structure is located on a floor 100.

Figure 20:
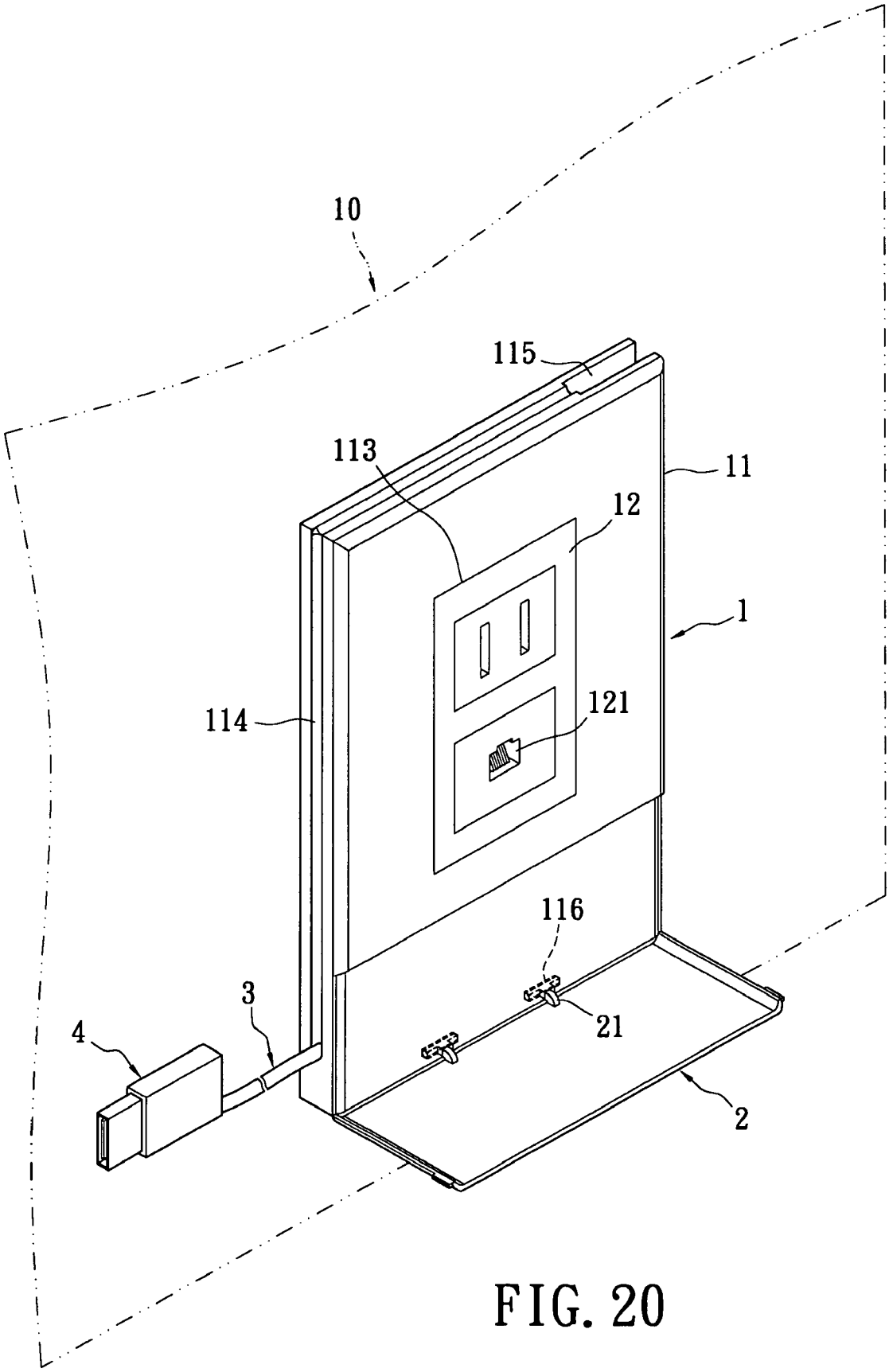
FIG. 20 is a perspective view of the eighteenth embodiment of the present invention.

Reference is made to FIG. 20, which shows the eighteenth embodiment of the present invention. Therein the socket assembly structure is located on a folding screen structure 10 (i.e. a partition structure).

Figure 21:
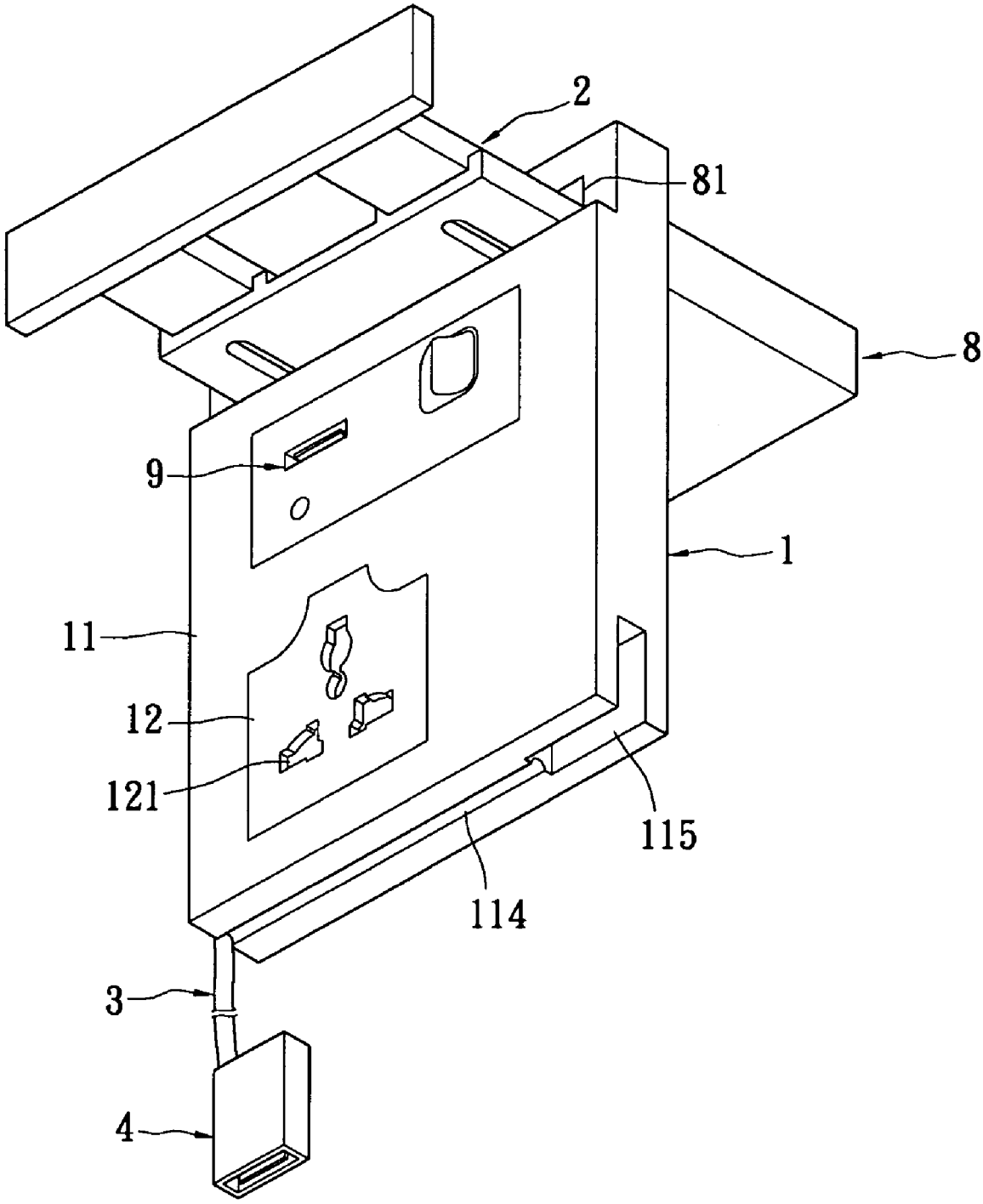
FIG. 21 is a perspective view of the nineteenth embodiment of the present invention.

Reference is made to FIG. 21, which shows the nineteenth embodiment of the present invention, which has a receiving box 8, the front side of the receiving box 8 has an opening 81. The receiving box 8 is located at the rear side of the panel 11. The carrying board 2 is correspondingly located in the opening 81 of the receiving box 8, and the carrying board 2 can slide forwards and backwards along the opening 81. Additionally, a connector 9 is located on the socket body 1.

Figure 22:
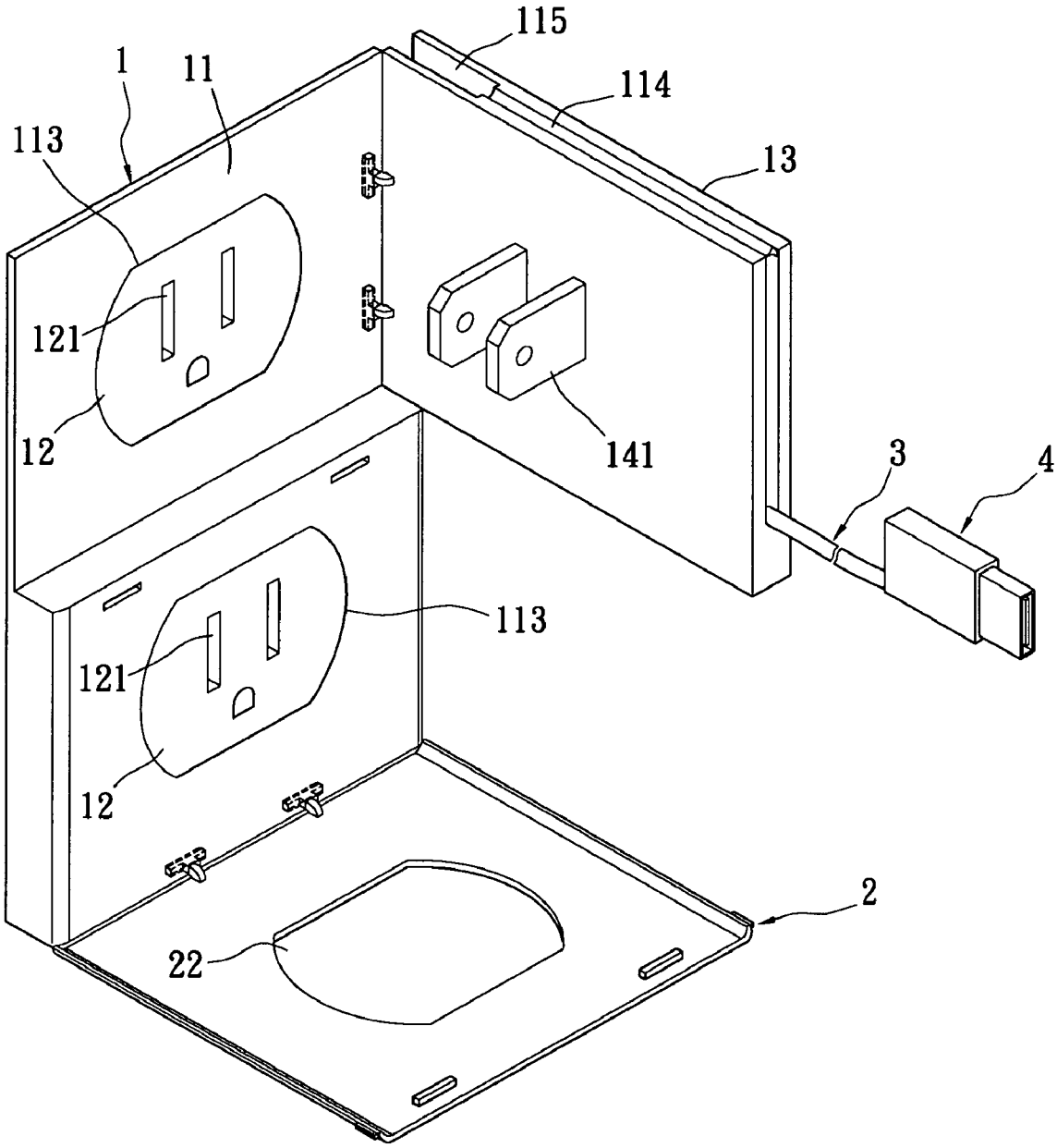
FIG. 22 is a perspective view of the twentieth embodiment of the present invention.

Reference is made to FIG. 22, which shows the twentieth embodiment of the present invention. Therein the socket unit 12 is of US specification, and the front side of the panel 11 has a front panel 13. The front panel 13 is coupled to one side of the panel 11 and a charging base (not shown) is located on the front panel 13. The rear side of the charging base has a pin 141, and the front side of the charging base has a connector (not shown). Therein when the charging base needs to be used, then the charging base may be rotated in relation to the panel 11, so that the charging base may be selectively plugged into the plug holes 121 of the socket unit 12. Thereby the pin 141 of the charging base may achieve electrical contact with the pin (not shown) of the plug holes 121 of the socket unit 12, and power may be transmitted to the connector of the charging base to charge an electronic equipment.

Figure 23:
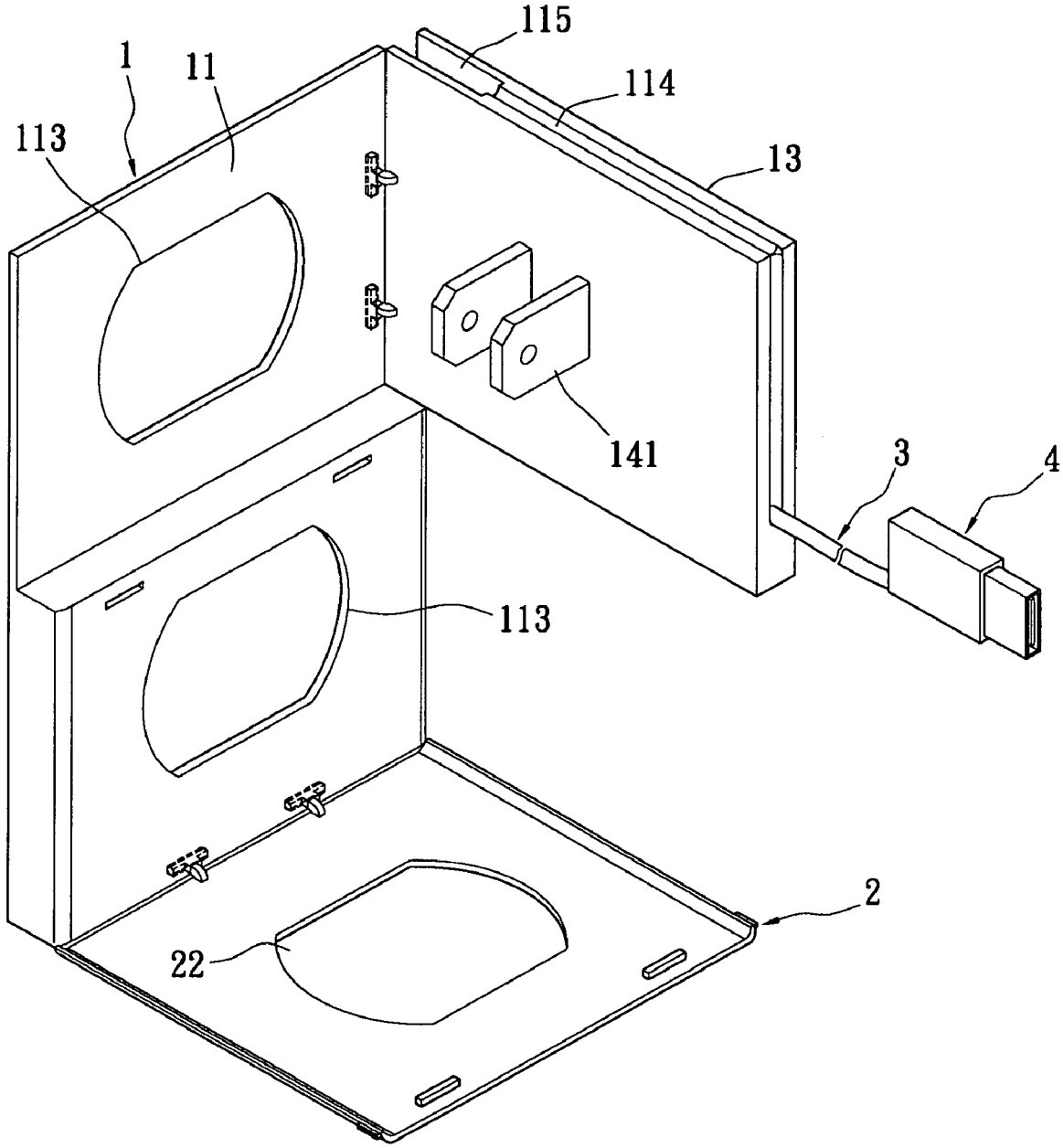
FIG. 23 is a perspective view of the twenty-first embodiment of the present invention.

Reference is made to FIG. 23, which shows the twenty-first embodiment of the present invention. Therein the socket body 1 only has a panel 11, and the aforementioned socket unit 12 is omitted.

The description above only illustrates specific embodiments and examples of the present invention. The present invention should therefore cover various modifications and variations made to the herein-described structure and operations of the invention, provided they fall within the scope of the present invention as defined in the following appended claims.

What is claimed is:

1. A socket assembly comprising:

a socket body having at least one socket unit on a front surface and a connector receiving groove on a side surface;

a connecting wire extended from the socket body;

an outlet connector on the exposing end of the connecting wire, the connecting wire being windable around the side peripheral of the socket body, and the outlet connector being receivable in the connector receiving groove of the socket body; and a carrying board is positioned to the front of the socket body and rotatably connected to the socket body;

wherein the socket body has a panel and the panel is connected to the at least one socket unit;

wherein the panel has a front board and a rear board that are stacked together, the panel has a wedging portion and the wedging portion is a through hole that corresponds to the at least one socket unit; and wherein a front surface of the panel has two first pivoting portions and one side surface of the carrying board has two second pivoting portions, wherein the first pivoting portions and the second pivoting portions are pivotally connected to each other.

2. The socket assembly as claimed in claim 1, wherein the wedging portion is wedged correspondingly with the outer edge of the socket unit.

3. The socket assembly as claimed in claim 1, wherein a wire slot is indented and located on the side peripheral of the socket boy, the connector receiving groove is adjacently connected to one end of the wire slot, and the connecting wire selectively routes within the wire slot of the socket body.

4. The socket assembly as claimed in claim 1, wherein the connector receiving groove is located on the side peripheral of the socket body.

5. The socket assembly as claimed in claim 1, wherein the outlet connector is a universal serial bus (USB) connector, an IEEE1394 connector, a high-definition multimedia interface (HDMI) connector, an audio video (AV) connector, or a direct current (DC) connector.

6. The socket assembly as claimed in claim 5, wherein the connector is a female-type connector or a male-type connector.

7. A socket assembly comprising:

a socket body having a connector receiving groove on a side surface;

a connecting wire extended from the socket body;

an outlet connector on the exposing end of the connecting wire, the connecting wire being windable around the side peripheral of the socket body, and the electrical connector being receivable in the connector receiving groove of the socket body; and a carrying board is positioned to a front of the socket body and rotatably connected to the socket body;

wherein the socket body has a panel and the panel is connected to at least one socket unit;

wherein the panel has a front board and a rear board that are stacked together, the panel has a wedging portion and the wedging portion is a through hole that corresponds to the at least one socket unit; and wherein a front surface of the panel has two first pivoting portions and one side surface of the carrying board has two second pivoting portions, wherein the first pivoting portions and the second pivoting portions are pivotally connected to each other.

8. The socket assembly according to claim 7, wherein a wire slot is located on the side peripheral of the socket body, the connector receiving groove is adjacently connected to one end of the wire slot, and the connecting wire selectively routes within the wire slot of the socket body.

9. The socket assembly according to claim 7, wherein the connector receiving groove is located on the side peripheral of the socket body.

10. A socket assembly comprising:

a socket body having at least one socket unit on a front surface;

a connecting wire extended from the socket body;

an outlet connector on the exposing end of the connecting wire, the connecting wire being windable around the side peripheral of the socket body; and a carrying board is positioned to the front of the socket body and rotatably connected to the socket body;

wherein the socket body has a panel and the panel is connected to at least one socket unit;

wherein the panel has a front board and a rear board that are stacked together, the panel has a wedging portion and the wedging portion is a through hole that corresponds to the at least one socket unit; and wherein a front surface of the panel has two first pivoting portions and one side surface of the carrying board has two second pivoting portions, wherein the first pivoting portions and the second pivoting portions are pivotally connected to each other.

* * * * *